US011358787B2

(12) United States Patent
Grip et al.

(10) Patent No.: US 11,358,787 B2
(45) Date of Patent: Jun. 14, 2022

(54) MODULAR CARGO CONTAINERS WITH SURFACE CONNECTORS

(71) Applicant: THE BOEING COMPANY, Chicago, IL (US)

(72) Inventors: Robert Erik Grip, Rancho Palos Verdes, CA (US); Michael S. Karapetian, Huntington Beach, CA (US); John J. Brown, Costa Mesa, CA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/720,166

(22) Filed: Dec. 19, 2019

(65) Prior Publication Data

US 2021/0188534 A1 Jun. 24, 2021

(51) Int. Cl.

| | |
|---|---|
| ***B65D 21/02*** | (2006.01) |
| ***B65D 90/00*** | (2006.01) |
| ***B65D 88/12*** | (2006.01) |
| ***B65D 88/14*** | (2006.01) |

(52) U.S. Cl.

CPC ..... *B65D 90/0006* (2013.01); *B65D 88/121* (2013.01); *B65D 88/14* (2013.01); *B65D 90/008* (2013.01)

(58) Field of Classification Search

CPC .... B65D 88/14; B65D 88/121; B65D 88/022; B65D 90/0006; B65D 90/008; B65D 90/0026; B65D 2590/0008; B65D 21/0201; B65D 21/02; B65D 21/00; B65D 21/0215; B65D 21/0204

USPC ..... 220/4.26, 4.27, 23.2, 1.5, 23.4, 23.6

See application file for complete search history.

(56) References Cited

U.S. PATENT DOCUMENTS

| | | | | |
|---|---|---|---|---|
| 3,563,403 | A | 2/1971 | Luisada et al. | |
| 3,598,273 | A | 8/1971 | Rau et al. | |
| 3,706,392 | A | 12/1972 | Sprick et al. | |
| 3,711,902 | A * | 1/1973 | Eggert, Jr. ..... | B60P 7/13 24/287 |
| 3,966,075 | A | 6/1976 | Schultz | |
| 4,695,184 | A * | 9/1987 | Robishaw ..... | B60P 7/13 114/249 |
| 4,759,668 | A | 7/1988 | Larsen et al. | |

(Continued)

FOREIGN PATENT DOCUMENTS

| | | | |
|---|---|---|---|
| FR | 2732313 | A1 | 10/1996 |
| GB | 2485333 | A | 5/2012 |
| WO | 2010106367 | A2 | 9/2010 |

OTHER PUBLICATIONS

European Patent Office Extended European Search Report for Application No. 20211436.9-1016 dated May 11, 2021.

*Primary Examiner* — Don M Anderson
*Assistant Examiner* — Elizabeth J Volz
(74) *Attorney, Agent, or Firm* — Patterson + Sheridan, LLP

(57) ABSTRACT

Certain aspects of the present disclosure provide a modular container, including: six sides, wherein: each side of the six sides of the modular container comprises at least four surface connectors, each surface connector of the at least four surface connectors comprises at least two connector elements, at least one connector element of the at least two connector elements is of a first type, and at least one connector element of the at least two connector elements is of a second type; and an access door in at least one side of the six sides.

20 Claims, 23 Drawing Sheets

(56) References Cited

U.S. PATENT DOCUMENTS

| | | | | |
|---|---|---|---|---|
| 6,010,021 | A * | 1/2000 | Zuidam | B65D 21/02 206/499 |
| 6,299,008 | B1 | 10/2001 | Payne | |
| 10,308,424 | B2 * | 6/2019 | Vancampen | B65D 90/0026 |
| 10,947,036 | B2 | 3/2021 | Helou, Jr. | |
| 2007/0000921 | A1 | 1/2007 | Butler et al. | |
| 2017/0283114 | A1 * | 10/2017 | Marschall | B65D 21/0201 |
| 2018/0194548 | A1 * | 7/2018 | Helou, Jr. | B64C 7/00 |

* cited by examiner

1100

MODULAR CARGO CONTAINERS WITH SURFACE CONNECTORS

Aspects of the present disclosure relate to cargo containers, and in particular to modular cargo containers that include surface connector arrangements.

Cargo containers are moved about the world by various types of crafts, such as trucks, ships, trains, and aircraft. In order to facilitate shipment of goods in a global economy, standards for shipping containers have been developed to enable intermodal shipping. So-called "ISO" containers are containers with standardized outer dimensions as well as standardized fitting locations so that containers may reliably be carried from place to place by various types of crafts with complementary container connection equipment.

Unfortunately, the high-degree of standardization in container size and fitting locations means that smaller containers, which may be a better fit physically and economically for various types of cargo, are not usable with standardized container transport vehicles. Accordingly, there is a need for modular containers that come in a wider variety of sizes and that include connection features to allow agglomeration to larger containers that maintain compatibility with existing cargo container standards.

BRIEF SUMMARY

Certain embodiments provide a modular container, including: six sides, wherein: each side of the six sides of the modular container comprises at least four surface connectors, each surface connector of the at least four surface connectors comprises at least two connector elements, at least one connector element of the at least two connector elements is of a first type, and at least one connector element of the at least two connector elements is of a second type; and an access door in at least one side of the six sides.

Further embodiments provide an agglomerated container, including: a plurality of modular containers, wherein: each respective modular container of the plurality of modular containers comprises six sides, each side of the six sides of the respective modular container comprises at least eight connectors elements, wherein: a first subset of the eight connector elements are of a first type, a second subset of the eight connectors elements are of a second type, and each respective modular container of the plurality of modular container is connected to another modular container of the plurality of modular containers via an interface between one or more connector elements on a first side of the respective modular container and one or more connector elements of a first side of the another modular container.

Further embodiments provide a method of forming an agglomerated container, including: connecting a plurality of modular containers to form an agglomerated container, wherein: each respective modular container of the plurality of modular containers comprises six sides, each side of the six sides of the respective modular container comprises at least eight connectors elements, wherein: a first subset of the eight connectors elements is of a first type, and a second subset of the eight connectors elements is of a second type, and each respective modular container of the plurality of modular container is connected to another modular container of the plurality of modular containers via an interface between one or more connector elements on a first side of the respective modular container and one or more connector elements of a first side of the another modular container.

The following description and the related drawings set forth in detail certain illustrative features of one or more embodiments.

BRIEF DESCRIPTION OF THE DRAWINGS

The appended figures depict certain aspects of the one or more embodiments and are therefore not to be considered limiting of the scope of this disclosure.

To facilitate understanding, identical reference numerals have been used, where possible, to designate identical elements that are common to the drawings. It is contemplated that elements and features of one embodiment may be beneficially incorporated in other embodiments without further recitation.

DETAILED DESCRIPTION

Figure 1A:
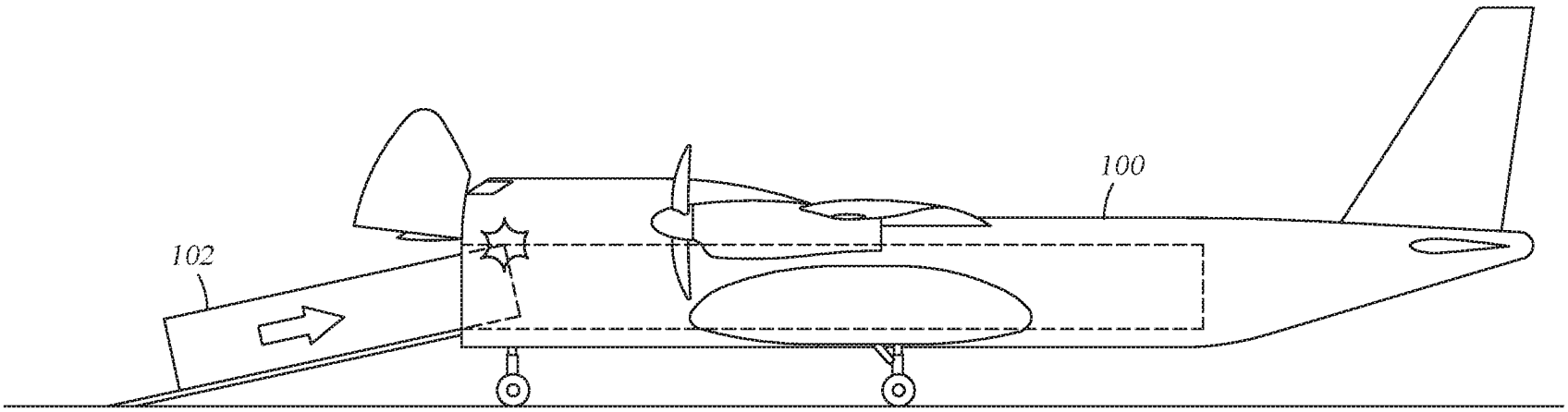
FIGS. 1A and 1B depict examples of loading large ISO containers on to an aircraft.

Aspects of the present disclosure provide modular containers that include connection features to allow agglomeration to larger containers, which in some arrangements maintain compatibility with existing cargo container standards.

Cargo carrying crafts, such as trucks, ships, trains, and aircraft move a great amount of cargo around the world. In order to do so efficiently, standardized container sizes and fittings have emerged to allow for efficient intermodal shipping.

Amongst the most commonly used container configurations in the world are the 20-foot and 40-foot "ISO" containers. Because of their common use, cargo carrying crafts, such as trucks, trailers, and rail cars, are generally configured with container connection equipment, such as retainers, mounts, locks, etc., that match complimentary container fittings on 20 and 40-foot containers. In some cases, larger containers, such as 45-foot, 48-foot, and 53-foot containers may still be carried by the same sort of craft using fittings that adhere to the 40-foot standard.

A shortcoming of larger ISO containers, such as 20 and 40-foot containers, is that cargo frequently must be "broken down" and reconsolidated into smaller loads along its route between origin and destination. As an example of this issue, consider a manufacturer of televisions in in a first location. In a given day, the manufacturer may produce enough TVs to fill an ISO container (e.g., a 20 or 40-foot ISO container). The ISO container is then loaded onto a truck, which takes it to a port, where it may be loaded onto a ship. At a destination port, the ISO container is unloaded from the ship, and then placed onto a truck or a train. However, at some point, the ISO container full of TVs must be unloaded and its contents separated and resorted because few customers may have a need for a whole ISO container full of TVs. For example, a retail store may want ten TVs at a time, not two hundred. This unloading and reloading takes time and energy, and thus reduces the efficiency of the shipping process. Further, this unloading and reloading increases the opportunities for damage and/or theft while in transit.

A related problem is the "less-than-load" problem. For example, a significant fraction of cargo-carrying trucks carry containers with cargo from more than one shipper. This is because many shippers or customers do not have enough cargo to fill a whole container. Consequently, shippers commonly arrange for a "freight forwarder" or third party logistics company to consolidate the cargo from two or more customers into a single container (e.g., an ISO container), so that a carrying craft (e.g., a truck) moves a full load. However, this consolidation process requires time, energy, and cost, and thus reduces the efficiency of the shipping process.

Further, large ISO cargo containers pose special challenges to certain types of cargo-carrying craft. For example, 20 and 40-foot ISO containers are difficult to load into an aircraft because of the large external dimensions of the containers and relatively constrained internal dimensions of the aircraft. For this reason, aircraft have conventionally used specially designed unit load devices (ULDs), which may be in the form of a pallet or container used to load luggage, freight, and mail on both wide-body and narrow-body aircraft. ULDs allow a large quantity of cargo to be bundled into a single unit, which reduces unit load count and saves ground crews time and effort. However, ULDs are not compatible with other intermodal cargo carrying vehicles. For example, ULDs cannot connect to ISO-standard connectors on trucks or trains, and so cargo in ULDs needs to be offloaded from the ULDs into ISO-compatible containers and vice versa several times in any shipment. Here again, this takes time and exposes the cargo to more opportunities for damage.

Figure 1B:
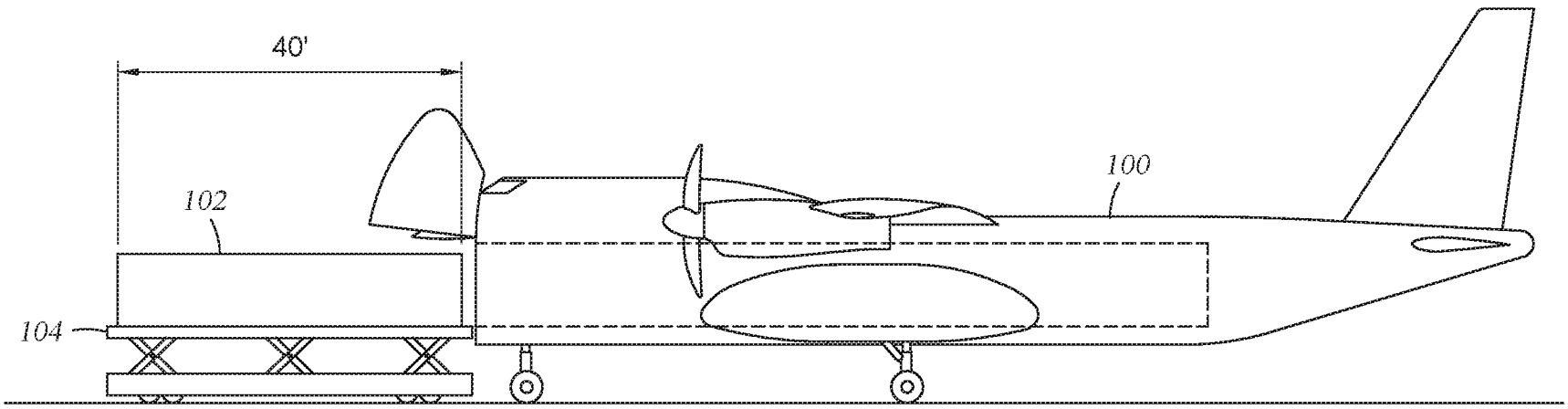

FIG. 1A depicts an example of a challenge in loading a 40-foot container 102 into aircraft 100. As depicted, the container 102 cannot be loaded using a ramp, despite the special purpose retracting nose of aircraft 100, because it will impact the interior of the cargo area of aircraft 100. Consequently, special machinery, such as lifting cart 104 in FIG. 1B, must be used to load and offload large cargo containers, such as ISO containers. Unfortunately, the requirement for specialized loading and unloading machinery means that aircraft, such as aircraft 100, can only be loaded and unloaded at airports that have such equipment. Getting and maintaining such equipment at many airports is costly and logistically complex.

Further, the large size of container 102 allows weight to be distributed unevenly across the area of container 102, which may negatively affect the center of gravity and thus performance of aircraft 100. For example, experimentation has shown that a 40-foot cargo container with uneven load may move the center of gravity of a cargo aircraft as much as ten feet, and a 20-foot cargo container may move the center of gravity as much as one and a half feet. Moving the center of gravity of an aircraft may negatively affect flight characteristics of the aircraft, such as stability and controllability. Further, movement of the center of gravity beyond an optimal location may require actively trimming the aircraft's aerodynamic surfaces to counter the center of gravity shift, which may lead to more drag, higher fuel usage, and slower flight. Carrying multiple containers (such as shown in the broken line in FIG. 1A) may exacerbate these issues.

Smaller standardized shipping containers exist, such as a "Bicon" container, which fits two containers in the space of a standard twenty-foot ISO container, a "Tricon" container, which fits three containers in the space of a standard twenty-foot ISO container, and a "Quadcon" container, which fits four containers in the space of a standard 20-foot ISO container. However, there are many issues with these existing containers that make them undesirable for modular shipping.

First, Bicons, Tricons, and Quadcons require special hardware to connect to each other's corner fitting in order that the connected unit can then be attached to standard connection equipment. Further, the special hardware adds weight, time, and cost to the use of such containers. Moreover, each of the corner fittings used for connecting adjacent containers is not available for connecting the joined containers to a carrying vehicle.

Second, Bicons, Tricons, and Quadcons need an approximate 3 inch gap between each container to accommodate the special connection hardware. The gap between the connected containers reduces the strength of the connected containers as a single structure because shear forces and loads run through the connectors instead of being shared by abutted walls of the containers.

Third, even though, for example, the Quadcon container is much smaller than a 20-foot ISO container, it is generally not small enough to relieve the less-than-load problem described above. For example, if a manufacturer produces a retail product such as an appliance that can be shipped in a box that has a volume of one cubic foot, a forty-foot container can carry approximately 3,000 of them; a 20-foot container can carry 1,500; and a Quadcon container can carry about 350. Thus, even the smallest of the standardized containers may carry far more cargo than needs to be shipped to any one location.

Fourth, Bicons, Tricons, and Quadcons have large tare weights because they are generally made of steel (being designed for rough duty in the military). Similarly, 20-foot and 40-foot ISO containers have large tare weights. While robust, the heavy tare weight of these containers makes them less efficient—which is especially problematic when carrying them on an aircraft. For these reasons, Bicon, Tricon, and Quadcon containers have not gained commercial acceptance.

Modular Container Arrangements

In order to increase the flexibility of moving cargo from place to place, modular containers are described herein, which are generally smaller than ISO standard containers, but which may be connected to each other to form large agglomerated containers that maintain compatibility with existing ISO standard connection equipment used by various sorts of transport vehicles. The modularity and size variability of the modular containers described herein provide for new capabilities for enclosing cargo for shipment.

Conceptually, one method of providing a family of smaller, modular containers is to sub-divide a container dimension over several iterations to obtain a family of smaller modular containers sizes that may be agglomerated to form back up to the larger ISO standard size. For example, in order to maintain compatibility with certain ISO standard sizes, a first container size may have a length (and optionally width and height) dimension of 95.727 inches (8-foot nominal), which may be divided in half results to obtain a two-segment dimension of 95.727/2=47.864 inches (nominally 4 feet). Further sub-dividing this dimension results in a four-segment dimension of 95.727/4=23.932 inches (nominally 2 feet), an eight-segment dimension of 95.727/8=11.966 inches (nominally 1 foot), and a sixteen-segment dimension of 95.727/16=5.983 inches (nominally 6 inches).

Figure 2:
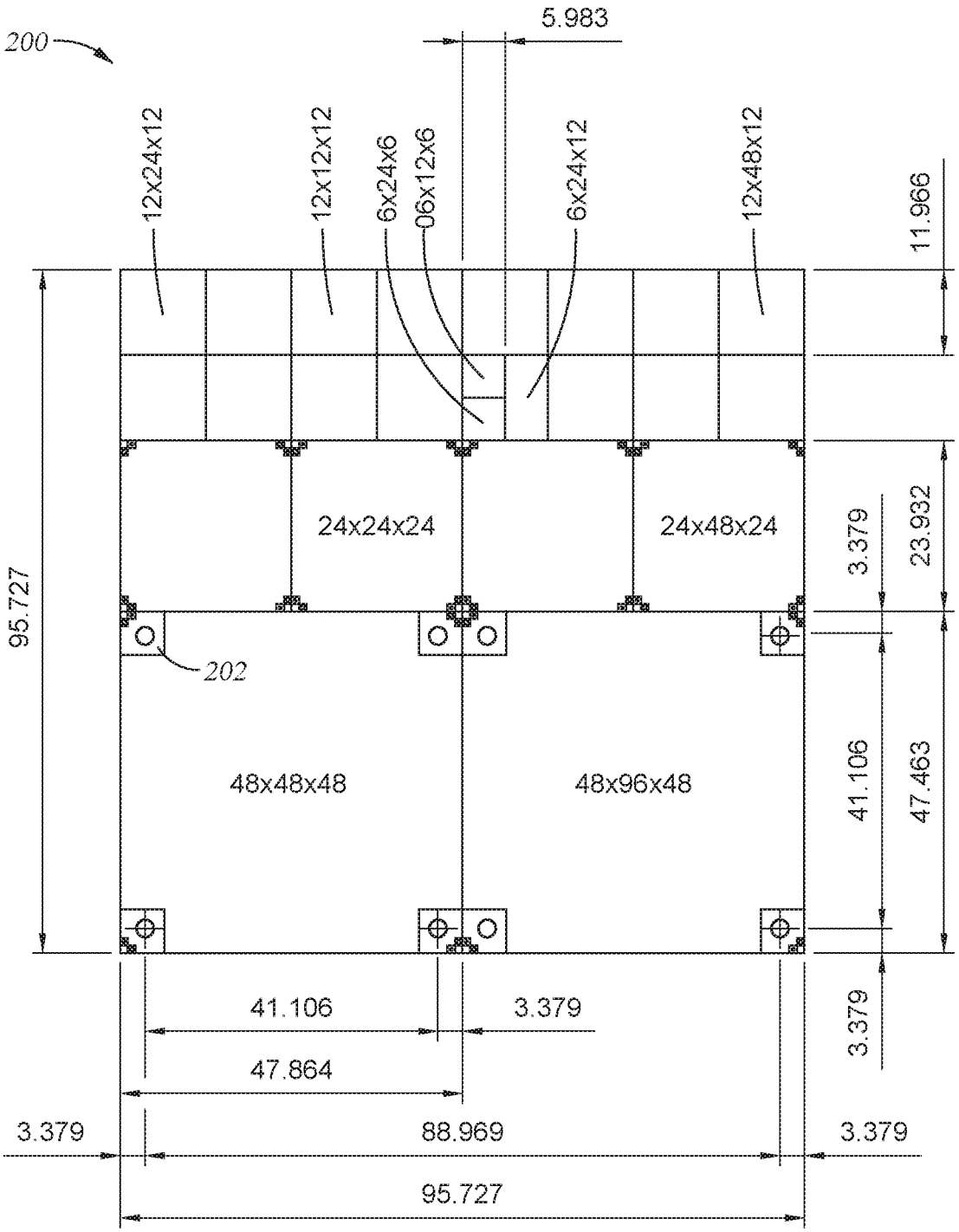
FIG. 2 depicts an example of a family of modular containers of varying sizes, which may be joined to form an agglomerated cube container.

FIG. 2 depicts an example of a family of modular containers of varying sizes and shapes, which may be joined to form an agglomerated container 200, which in this example is cubic in shape.

In particular, FIG. 2 depicts the use of 4-foot, 2-foot, 1-foot and, ½-foot modular cubes as well as 4-foot×8-foot×4-foot, 2-foot×4-foot×2-foot, 1-foot×2-foot×1-foot, 1-foot×4-foot×1-foot, 0.5-foot×2-foot×0.5-foot, and 0.5-foot×2-foot×1-foot foot modular containers. Note that for simplicity, in these examples, nominal dimension are provided. Actual dimensions for ½-foot nominal is approximately 5.983 inches, for 1-foot nominal is approximately 11.966 inches, for 2-foot nominal is approximately 23.932 inches, for 4-foot nominal is approximately 47.463 inches, and for 8-foot nominal is approximately 95.727 inches. Because each modular container's dimension is based on a consistent fraction of the next size larger, here ½, many arrangements can be used to form agglomerated containers that work with various existing ISO standard connection equipment on existing transport vehicles.

The modular containers in FIG. 2 are all rectangular cuboids. Generally, a cuboid is a three-dimensional shape comprising six faces that form a convex polyhedron. The faces of the cuboid can be any quadrilateral. Some cuboids are made from 6 rectangles that are placed at right angles, and a cuboid that uses all square faces is referred to as a cube.

Table 1, below, depicts various dimensions for modular containers as depicted in FIG. 2:

TABLE 1

Modular Container Dimensions

| Nominal Size (ft) | Nominal Size (in) | Face-to-Face Dimension (in) | Pin-to-Pin Dimension (in) |
|---|---|---|---|
| 0.5 | 6 | 5.983 | |
| 1 | 12 | 11.966 | 5.208 |
| 2 | 24 | 23.932 | 17.174 |
| 4 | 48 | 47.864 | 41.106 |
| 8 | 96 | 95.727 | 88.969 |

Notably, the "nominal" size provides an easy reference dimension, while the face-to-face and pin-to-pin dimensions are accurate to approximately the nearest 0.001 inch. Additionally, one-half of the difference between these dimensions is a 3.379-inch distance between the center of a hole and a corner fitting face, such as shown at 202, and this dimension is held constant throughout the various sized modular containers described in FIG. 2 and throughout. Note that for some smaller containers, such as 6-inch containers, there may be no corner fitting because it would consume the majority of the volume of the container. Thus, there is no pin-to-pin dimension in Table 1 for 6-inch modular container sizes.

Various size modular containers, such as those in Table 1, can be mixed and matched for specific shipping needs while still forming an agglomerated container in a size (e.g., an 8-foot cube) that is compatible with existing ISO standard connection equipment. Further yet, larger arrangements of agglomerated containers, such as five 8-foot agglomerated containers, may be joined to form a container that is compatible with larger ISO shipping container standards, such as the 40-foot ISO container standard.

Figure 3:
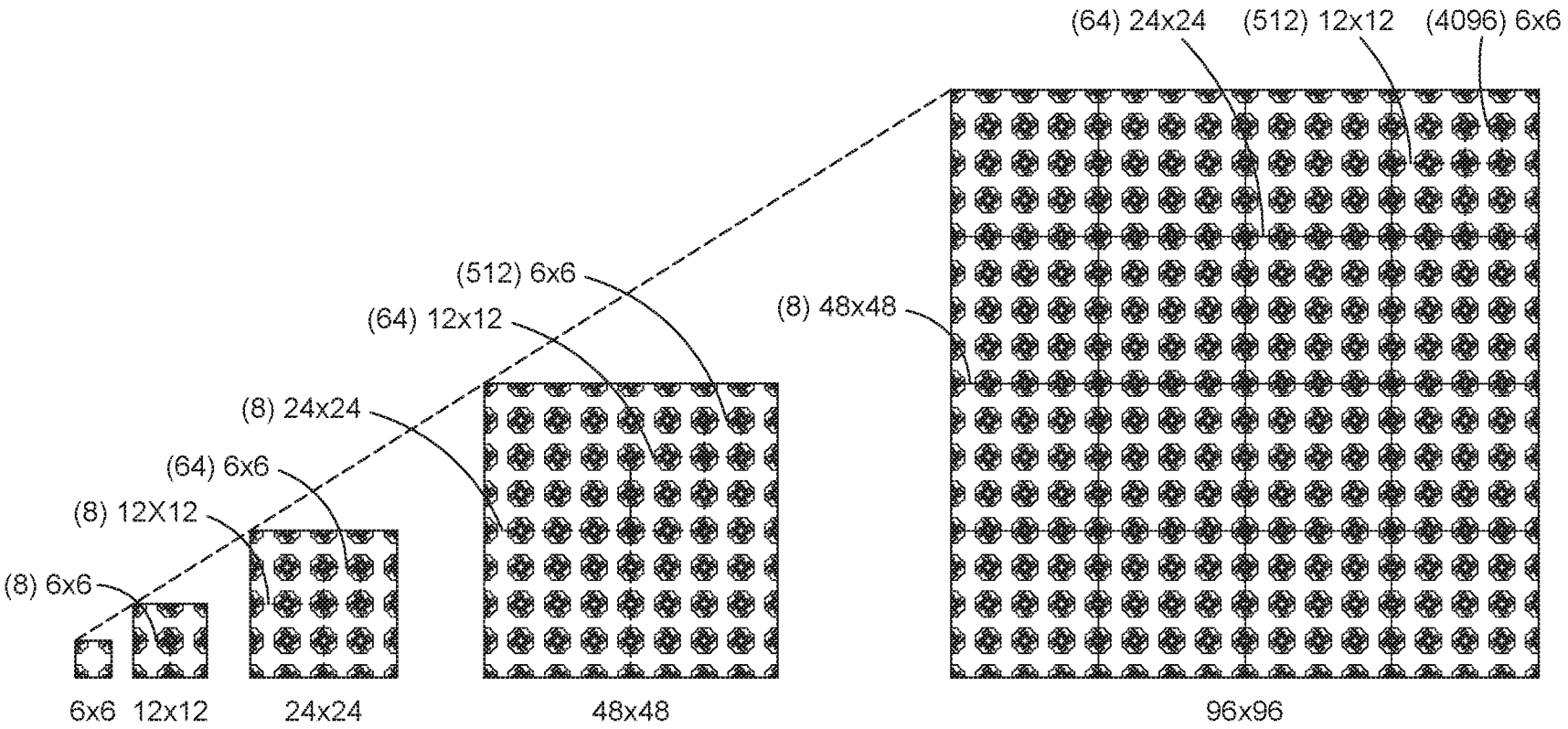
FIG. 3 depicts an example of how modular containers can be agglomerated to form larger agglomerated container sizes.

FIG. 3 depicts an example of how modular containers can be agglomerated to form larger agglomerated container sizes. For example, eight 6-inch cube containers may be fit together to form a 12-inch agglomerated cube container. As another example, eight 12-inch cube containers or sixty-four 6-inch cube containers may be fit together to form a 24-inch agglomerated cube container. As yet another example, eight 24-inch cube containers, sixty-four 12-inch cube containers, or five hundred and twelve 6-inch cube containers may be fit together to form a 48-inch agglomerated cube container. As an additional example, eight 48-inch cube containers, sixty-four 24-inch cube containers, five hundred and twelve 12-inch cube containers, or four thousand and ninety-six 6-inch cube containers may be fit together to form a 96-inch agglomerated cube container. Note that while these examples all refer to cubic container geometries, as discussed herein, modular containers and agglomerated containers need not be cubic, and they need not be comprised of modular containers of all the same size.

Figure 4:
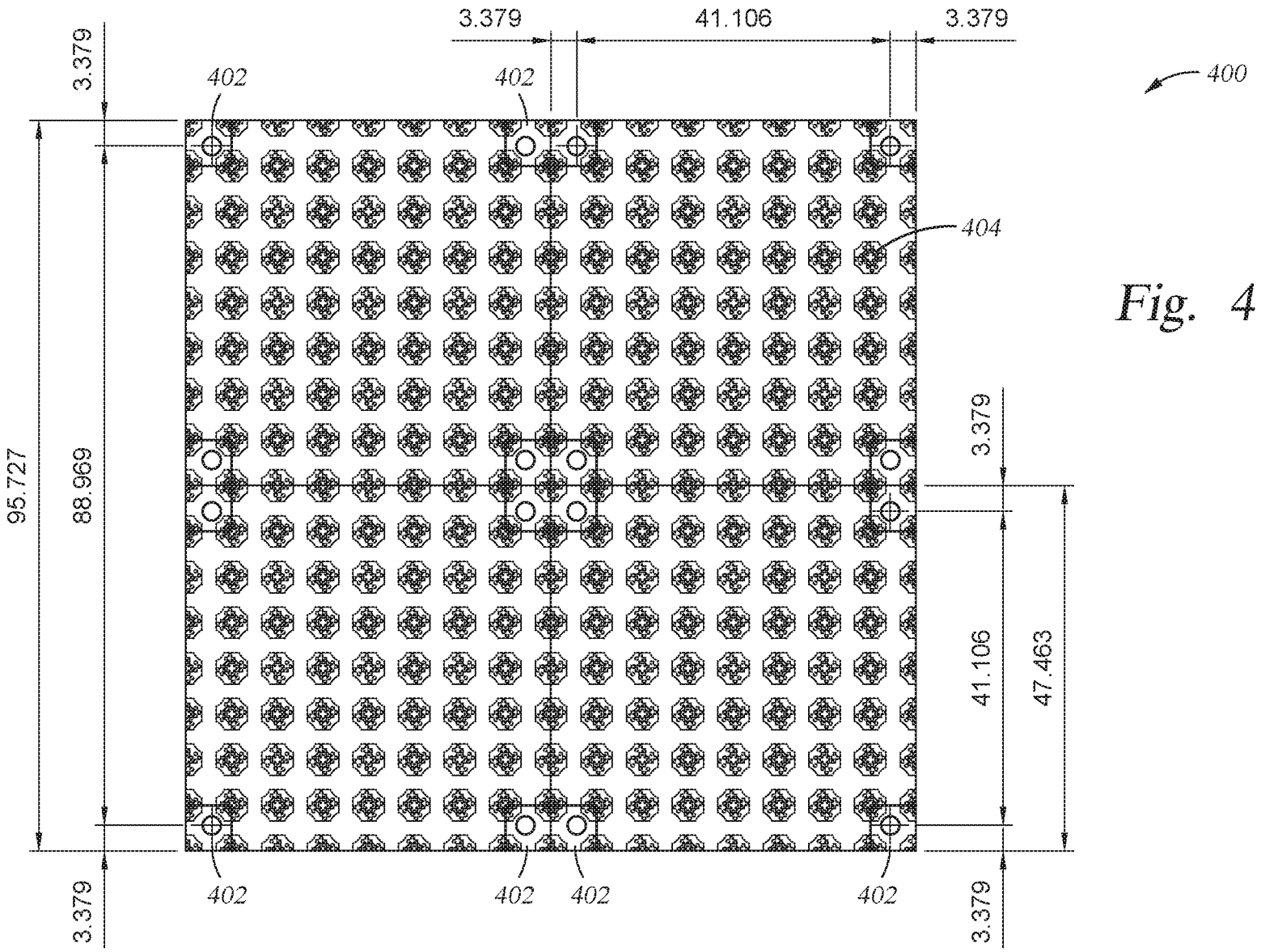
FIG. 4 shows an example arrangement of modular containers forming an agglomerated container.

FIG. 4 depicts an arrangement of eight modular 4-foot cube containers forming an agglomerated container 400 that can fit into the volume occupied by an 8-foot cube.

In this example, agglomerated container 400 includes corner fittings 402 that make it compatible with ISO connection hardware. As depicted, the corner fitting hole to corner fitting hole dimension when the modular 4-foot cube containers are joined remains approximately 88.969 inches, which is consistent with the ISO standard. Similarly, the container edge to container edge distance (i.e., container extent in a given dimension) remains 95.727 inches, which allows for the arrangement of containers to work with standard 20 and 40-foot ISO container connection equipment (e.g., on trailers, rail cars, and the like). For example, five agglomerated containers like container 400 may be arranged together to fit standard 40-foot ISO standard connection equipment.

Further in this example, each of the modular 4-foot cube containers includes surface connectors 404 configured to allow attachment to an adjacent modular 4-foot cube containers (in this example) or to other smaller modular containers that include complementary connectors. The surface connectors will be described in more detail below with respect to FIGS. 8-12.

Figure 5:
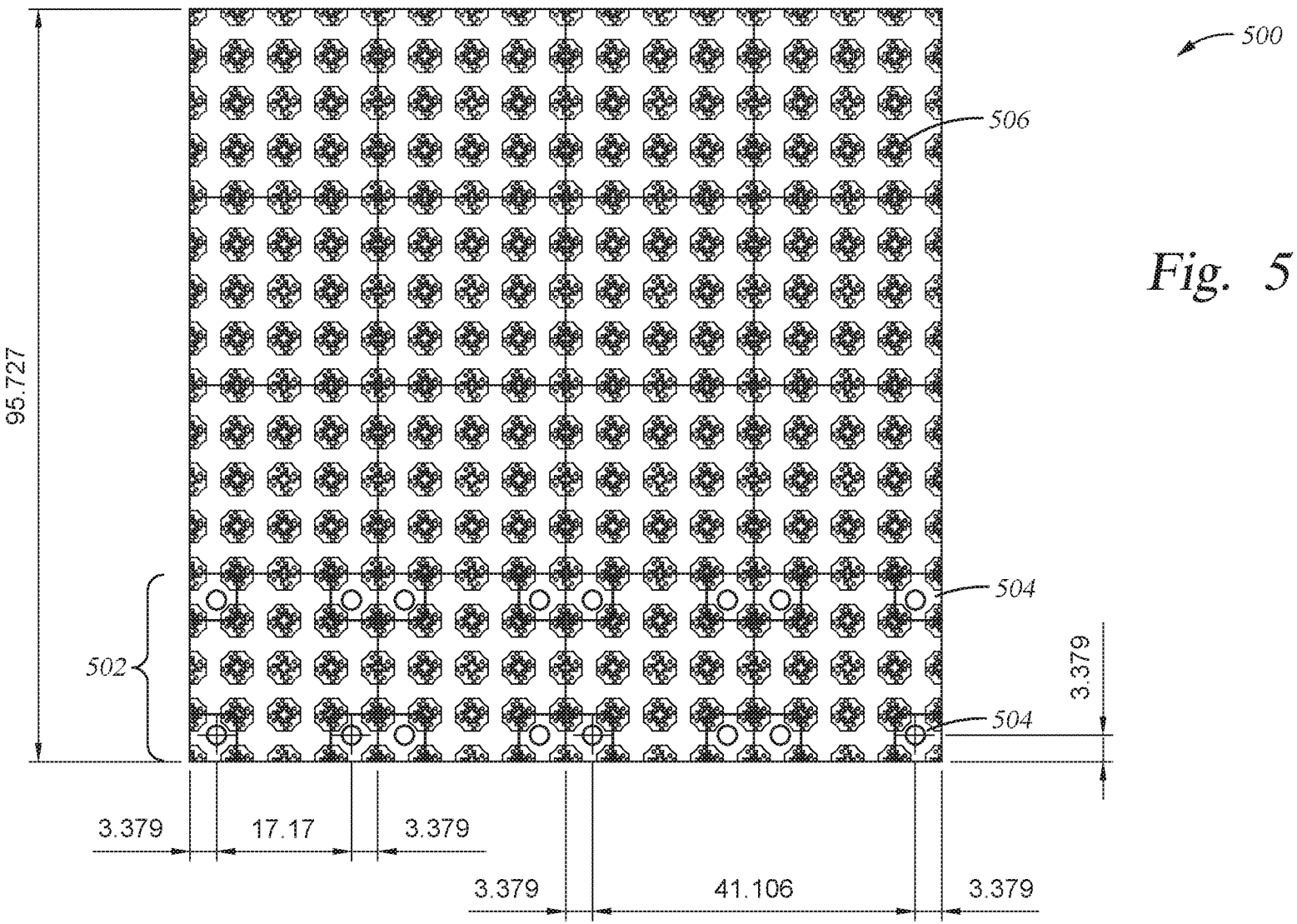
FIG. 5 depicts another example arrangement of modular forming an agglomerated container.

FIG. 5 depicts another example of using modular containers to form an agglomerated container 500.

In the depicted example, sixty-four modular 2-foot cubes are attached to form an agglomerated container 500 that fits within the volume of an 8-foot cube container. Here again, the edge dimensions of the agglomerated container are approximately 95.727 inches, which allows the agglomerated containers to be used with ISO standard connection equipment.

Unlike in FIG. 4, in this example, only the bottom layer 502 of modular 2-foot containers has the ISO-compatible corner fittings 504. In this arrangement, for example, the lower four corner fittings (at each of the lower edges of the agglomerated cube) will function in the same manner as described for an 8-foot ISO-compatible container.

In another embodiment (not depicted), the ISO-compatible corner fittings could be limited to only the modular 2-foot containers in the corners of agglomerated container 500 to maximize the storage capacity of all containers that do not have the ISO-compatible corner fittings and to minimize tare weight of agglomerated container 500.

Further in this example, all of the modular 2-foot containers include surface connectors 506 configured to allow attachment to an adjacent modular 2-foot cube containers (in this example) or to other modular containers that include complementary connectors. By using the surface connectors 506 on all of the modular 2-foot cube containers other than the bottom layer (in this example), rather than corner fittings, usable volume within agglomerated container 500 is increased.

Figure 6:
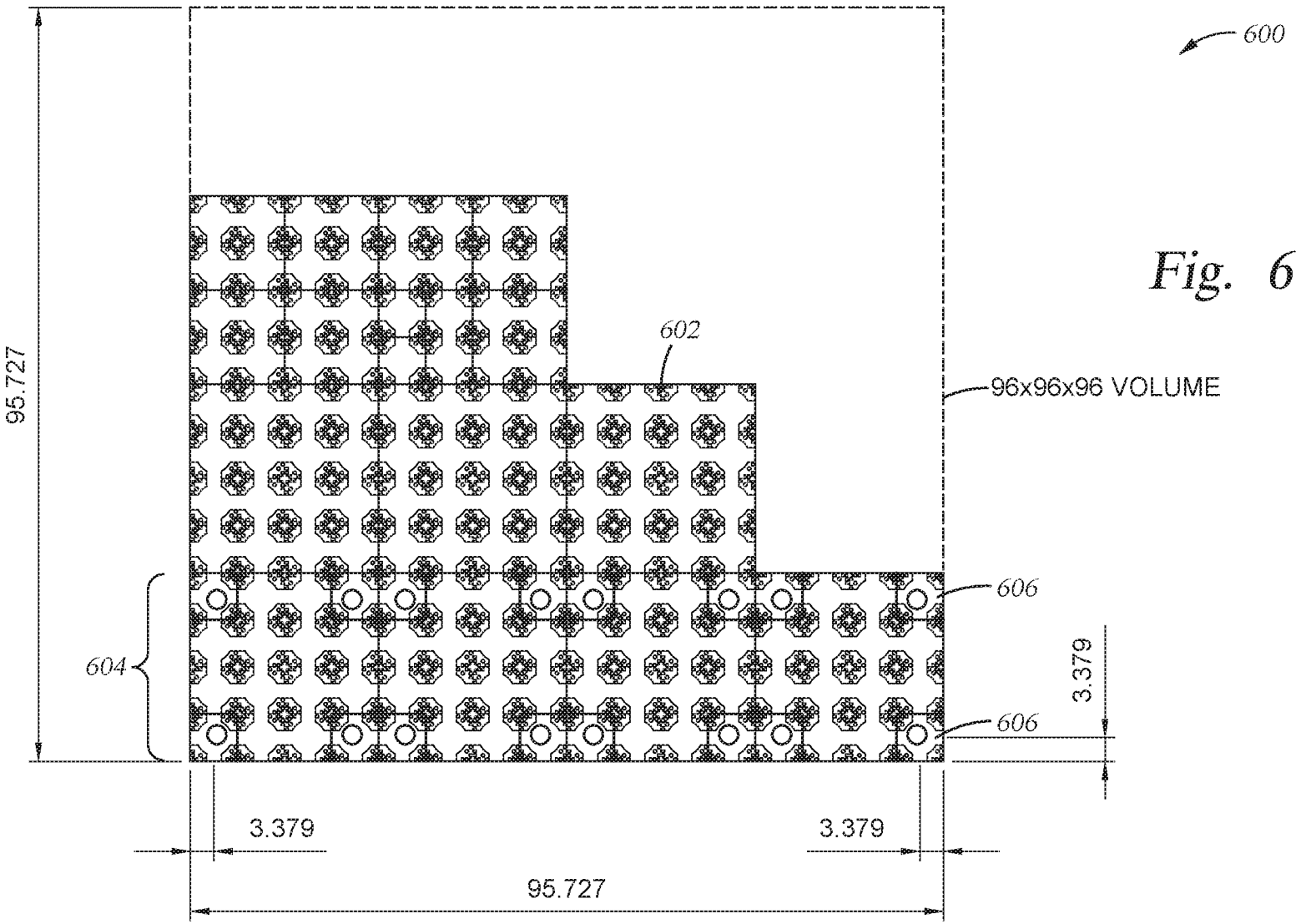
FIG. 6 depicts another example arrangement of modular forming an agglomerated container.

FIG. 6 depicts another example of using modular containers to form an agglomerated container 600. However, in this example, agglomerated container 600 is not cubic (or a rectangular cuboid).

Rather, FIG. 6 depicts how a non-uniform agglomeration of smaller containers may be used while still taking advantage of ISO standard connection equipment. In this example, the bottom layer 604 of modular containers in agglomerated container 600 has a square cross-sectional area (or footprint) and each modular container on the bottom layer 604 includes ISO-compatible corner fittings (e.g., 606), which enables connection to ISO standard connection equipment. The layers above bottom layer 604, by contrast, have different cross-sectional areas (or footprints) owing to the different configuration of connected modular containers in each layer.

Further, this example shows the versatile shipping possibilities of modular containers with surface connectors (e.g., 602). As depicted, modular containers may be picked up and connected to agglomerated container 600 or disconnected and dropped off from agglomerated container 600 while in route between an origin and multiple destinations. And this can be done without disturbing cargo in any of the other modular containers.

Figure 7A:
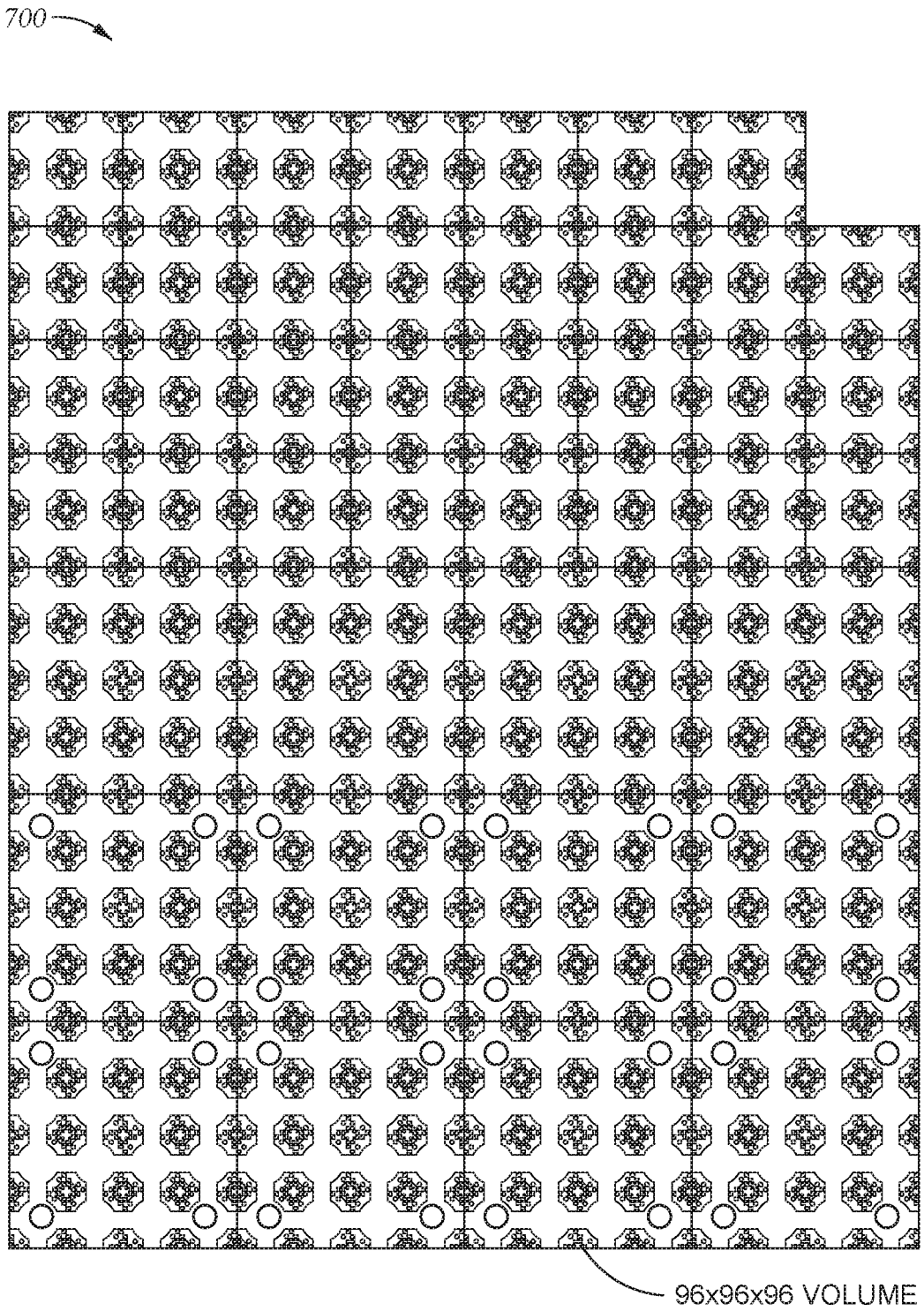
FIGS. 7A-7B depict examples of using modular containers of varying sizes to form agglomerated containers of non-standard shape.

FIG. 7A depicts another example of using modular container to form an agglomerated container 700. Notably, in this example, agglomerated container 700 is taller than a standard size ISO container 8-foot container. There may be many situations in which a non-standard size of container is preferable, such as when a container is being stored before or after transport (e.g., in a port) or when being shipped in a transport vehicle that has additional overhead space (e.g., a container ship).

Figure 7B:
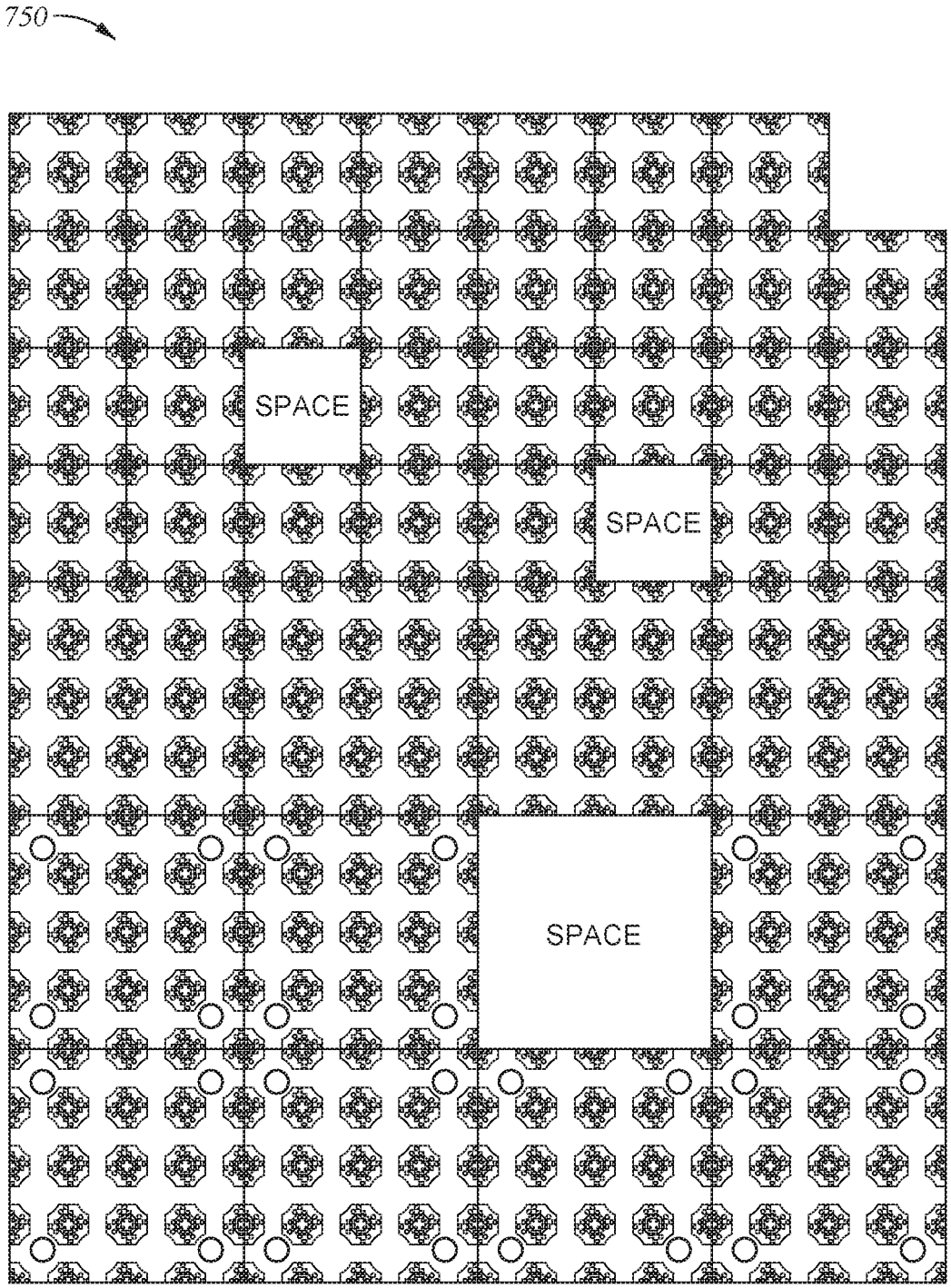

FIG. 7B depicts another example of using modular containers to form an agglomerated container 750. In this example, agglomerated container 750 includes voids in the structure, which are enabled by the other modular containers connecting to each other directly around the voids and providing structural support and stability despite the voids. Notably, while the voids in this example are shown as going all the way through agglomerated container 750, this need not be the case.

Notably, FIGS. 2-7B are just some examples of how modular containers with specific dimensions can be joined to form agglomerated containers that, for example, maintain compatibility with ISO connection equipment such that they can be used with existing transport vehicles in the intermodal shipping network. Other combinations of modular cube sizes are possible.

Further, FIGS. 2-7B demonstrate a solution to the less-than-load problem because shippers may choose to utilize smaller modular containers that can be attached to other modular containers to form larger agglomerated containers. This is more efficient in terms of space, because an agglomerated shipping container will tend to utilize more of its total volume for cargo, and more cost effective because an individual shipper need not pay for an entire container with a less than full load.

Furthermore, the modular shipping arrangements depicted in FIGS. 2-7B improve security and reduce the chance of damage to cargo because the smaller, modular containers need not be shared with other shipper's cargo (e.g., in the case of a cargo forwarder as discussed above), and the cargo need not be unloaded while in transit from origin to destination.

Surface Connector Arrangements for Connecting Modular Containers

Surface connectors are generally arrangements of structures on the surface of a modular container that enable the modular container to connect to other modular containers. Surface connectors may be corner-mounted, edge-mounted, or face-mounted, as depicted and described with respect to FIGS. 8-15B.

Corner-mounted surface connectors are generally located at the corner of a modular container and may extend across more than one face of the modular container. In some embodiments, the corner-mounted surface connectors may extend across the three adjacent faces of a modular container that all come together at a particular corner. Corner-mounted surface connectors generally comprise a plurality of connector elements disposed on the surfaces of the modular container, such as protrusions, recesses, and apertures. While depicted with square and circular cross-sections throughout the examples herein, they may take on any shape.

Edge-mounted surface connectors are generally located along an edge of a modular container and may extend across more than one face of the container. In some embodiments, the corner-mounted surface connectors may extend across two adjacent faces of a modular container that come together at a particular edge. Like corner-mounted surface connectors, edge-mounted surface connectors generally comprise a plurality of connector elements disposed on the surface of the modular container, such as protrusions, recesses, and apertures.

Face-mounted surface connectors are generally located along a face of a modular container. Like edge and corner-mounted surface connectors, face-mounted surface connectors generally comprise a plurality of connector elements disposed on the surface of the modular container, such as protrusions, recesses, and apertures.

Figure 8:
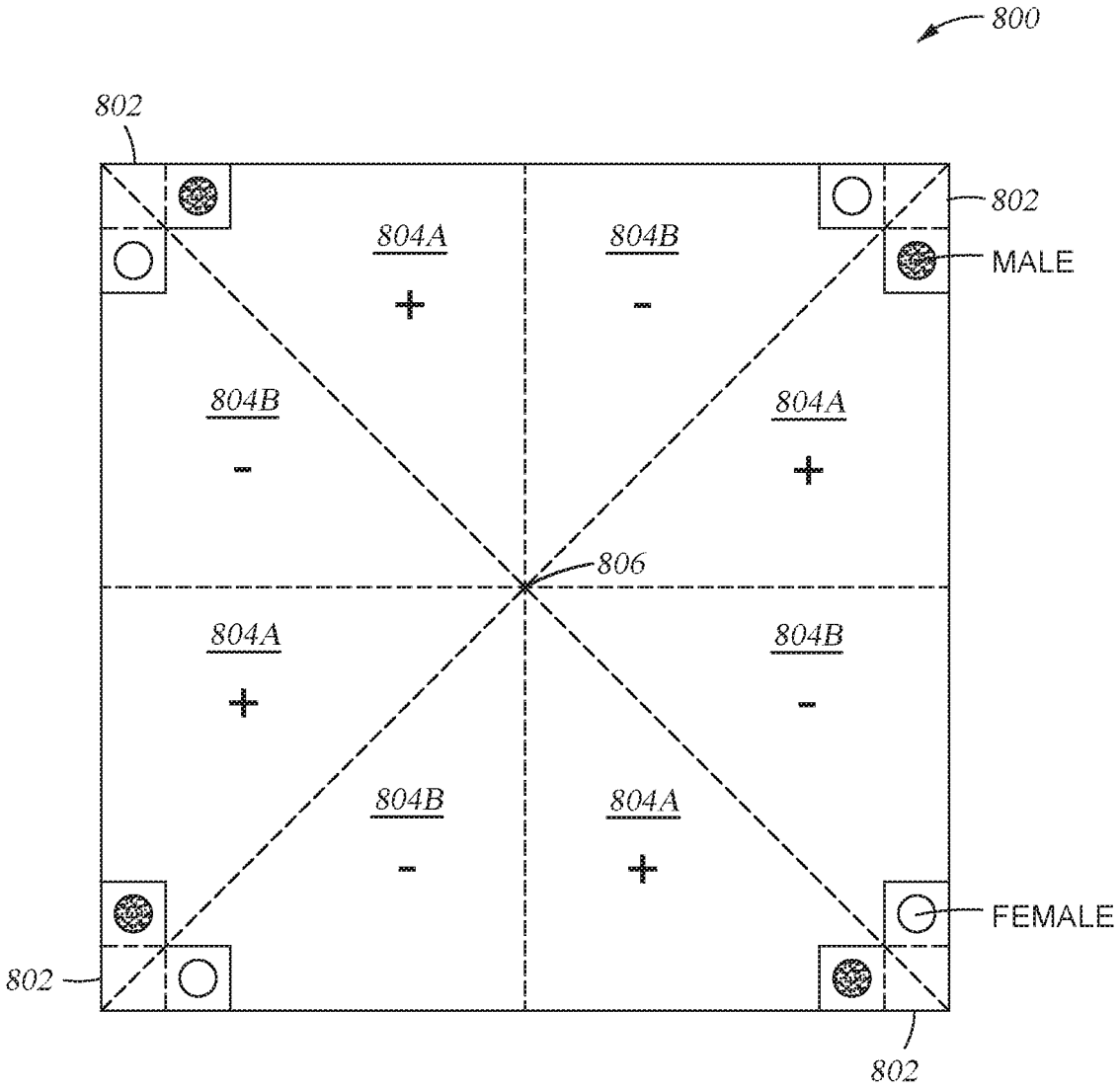
FIG. 8 depicts an example of corner-mounted surface connectors on a modular container.

FIG. 8 depicts an example of an arrangement of corner-mounted surface connectors on modular container 800.

In particular, each of the corner-mounted surface connectors 802 includes two connector elements that are complementary (e.g., male and female connector elements in this example), which allow containers having matching arrangements of connector elements to be interfaced without respect for orientation.

While depicted on the corners of container 800 in this example, the surface connectors could be placed in other locations on modular container 800 in other embodiments, such as along an edge or on a face of modular container 800. Preferably, such arrangements of surface connectors have rotational symmetry so that the orientation of modular containers does not matter when connecting them to each other. In this example, eight alternating zones 804A and 804B are arranged around the center 806 of the face, which show where complimentary surface connectors could be mounted while maintaining rotational symmetry about the face.

Figure 9A:
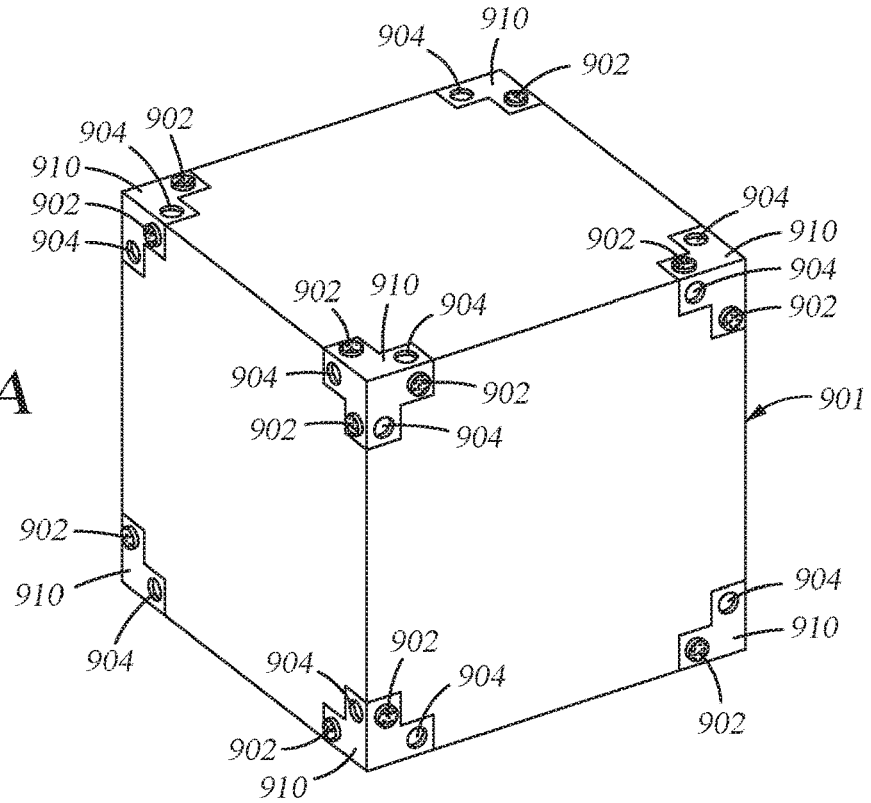
FIGS. 9A and 9B depict the example corner-mounted surface connectors of FIG. 8 in an isometric view.
Figure 9B:
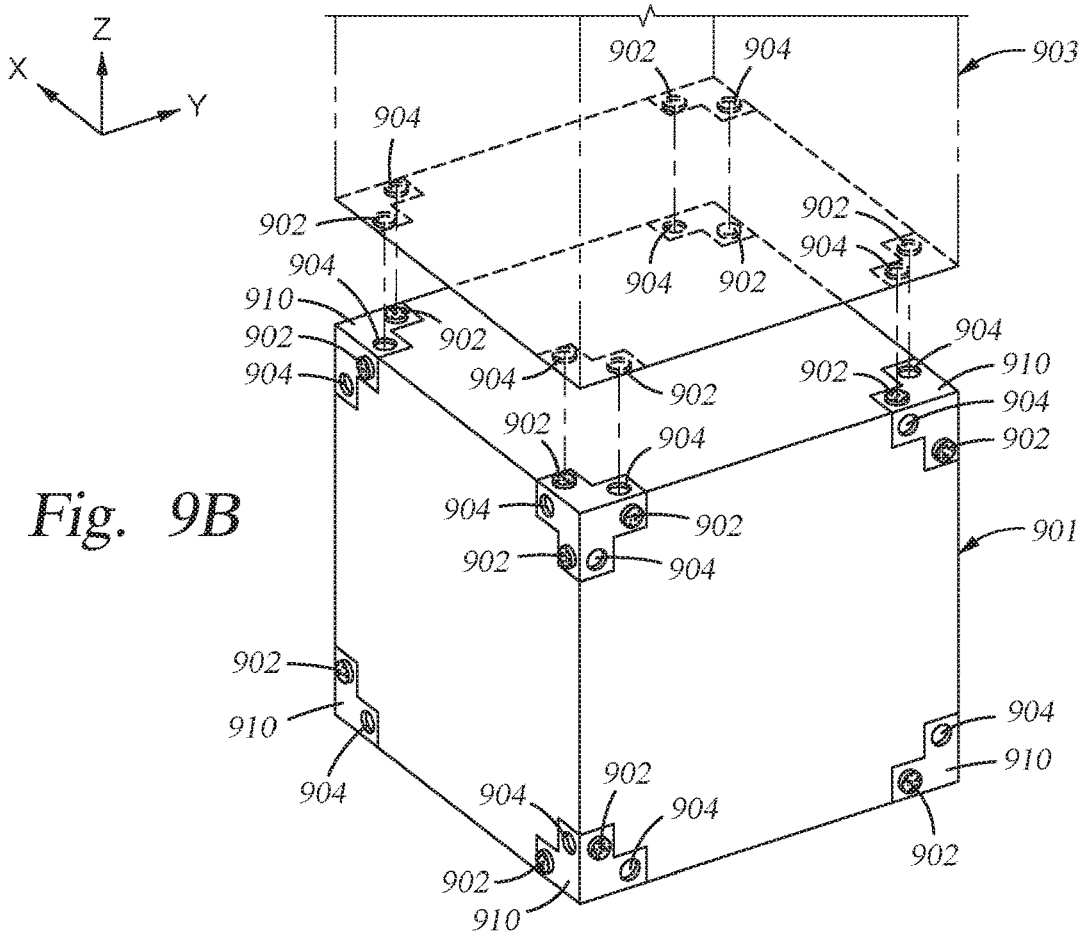

FIGS. 9A and 9B depict the example corner-mounted surface connector configuration of FIG. 8 in an isometric view.

In particular, FIG. 9A depicts an example of a modular container 901, such as those described above with respect to FIGS. 2-7B, including corner-mounted surface connectors 910 arranged at each corner of container 901. In particular, FIG. 9A depicts a first, second, and third face of modular container 901. Further in FIG. 9A, each of the faces of modular container 901 is separated by a container edge.

In this example, each corner-mounted surface connector 910 includes two connector elements 902 and 904 per exterior face of the corner-mounted surface connector. Thus, in this example, each face (or side) of container 901 (six in total) includes four corner-mounted surface connector faces and eight connector elements. Notably, the depicted corner-mounted surface connector arrangement allows room for a traditional corner fitting, such as an ISO-compatible corner fitting at each corner of container 901 (as indicated by the dashed lines).

In this example, for any given face of container 901, the connector elements 902 and 904 of each surface connector 910 are arranged in an alternating fashion. For example, connector elements 902 may be of a first type (e.g., type A, male, etc.) and connector elements 904 may be of a second type (e.g., type B, female, etc.). Thus, starting from one corner-mounted surface connector on a face of container 901 and moving around the perimeter of the face in either direction, the connector elements 902 and 904 alternate in type. For example, starting at any connector of type 902 on any face of container 901 and moving in one direction or another leads to a pattern of container connectors such as 902-904-902-904-902-904-902-904.

A first type of connector element (e.g., a "male" connector element) may comprise a protrusion configured to fit within a recess of a second type of connector element (e.g., a "female" connector element). In some embodiments, connector elements 902 and 904 may further include latches, magnetic connectors, pit pins, threaded rods, etc. In some embodiments, the connector elements may be manually locked and unlocked by means of a lever or other mechanical device, or they may be electrically activated by a powered mechanism inside the container.

As depicted in FIG. 9B, this arrangement of connector elements allows modular containers, such as 901 and 903, to connect with each other in any orientation. For example, modular container 903 may be turned 90 degrees, 180 degrees, or 270 degrees on any axis (e.g., X, Y, or Z) and still align with container 901 such that connector elements of a first type (e.g., male) on container 903 align with connector elements of a second, complementary type (e.g., female) on container 901. The flexibility enabled by this surface connector arrangement makes it easier to connect containers of various shapes to each other to build up larger agglomerated containers, such as shown above in FIGS. 2-7B.

Figure 10A:
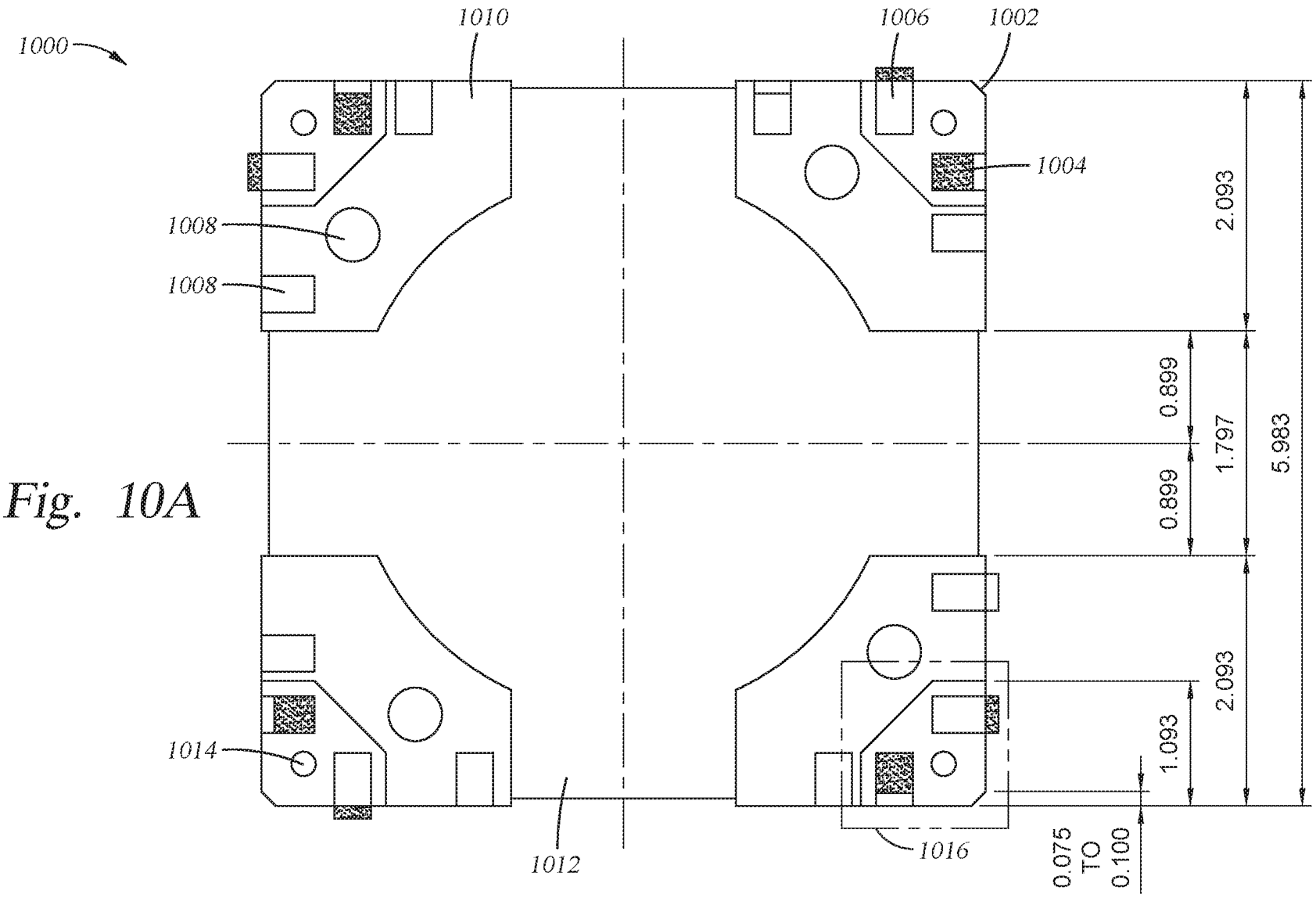
FIGS. 10A and 10B depict aspects of corner-mounted surface connector arrangements for modular containers.
Figure 10B:
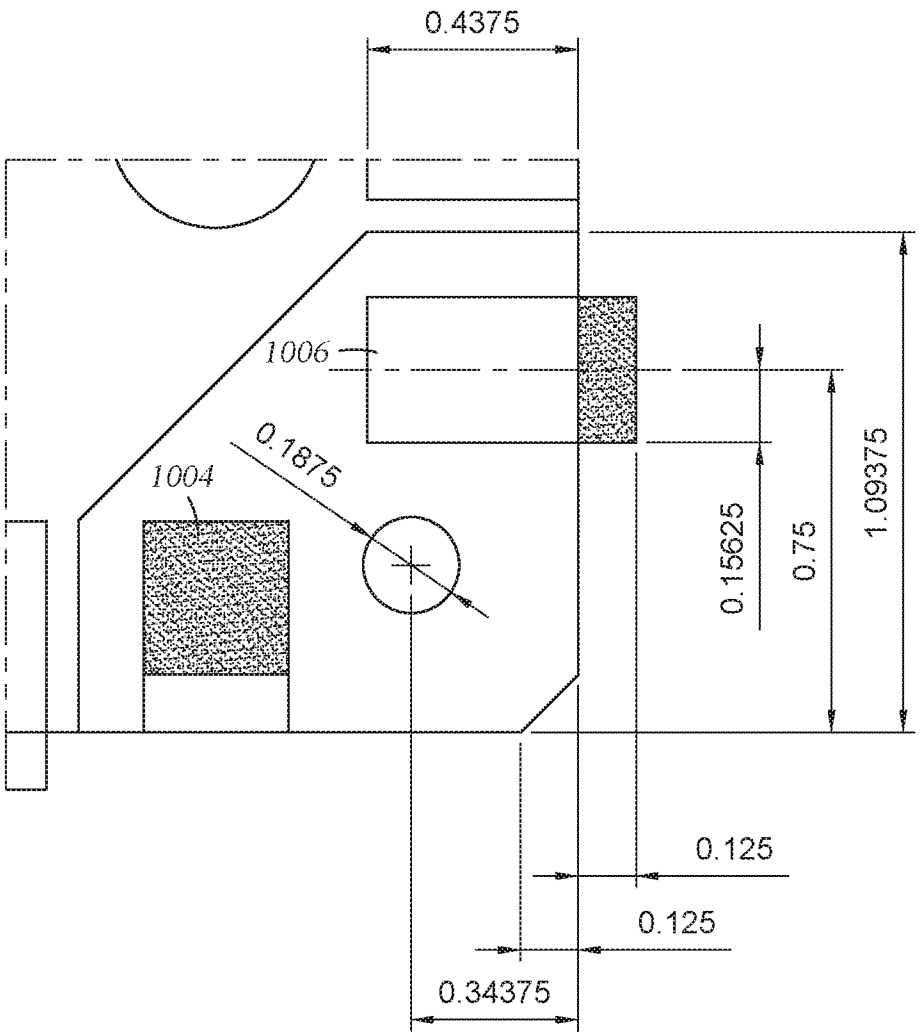

FIGS. 10A and 10B depict aspects of another corner-mounted surface connector arrangement for modular containers.

In FIG. 10A, modular container 1000 is a 6-inch cube container that includes corner-mounted surface connectors 1002 with integral male connector elements 1004 and female connector elements 1006. Corner-mounted surface connectors may with the dimensions depicted in this example may be referred to herein as "small" corner-mounted surface connectors. Note that the corner-mounted surface connectors 1002 depicted in FIG. 10A are just one type of surface connector arrangement, and many are possible.

Modular container 1000 also includes additional female surface connectors 1008 to accommodate intermediate sized corner fittings, as discussed in more detail below. Note that these additional surface connectors are optional.

Modular container 1000 also includes recesses 1012 from the face of the container 1010, which allow for additional attachment or securing means, such as straps. Further, modular container 1000 includes apertures 1014 in each corner fitting 1002 to allow for automated articulation, such as grasping and moving by a robot or effector.

Note that while corner fittings 1002 are shown on a 6-inch modular cube container in this example, corner fittings 1002 may be used on any size modular container. This is just one example.

FIG. 10B depicts further details of small corner-mounted surface connector 1002 as shown in box 1016 of FIG. 10A.

Figure 11A:
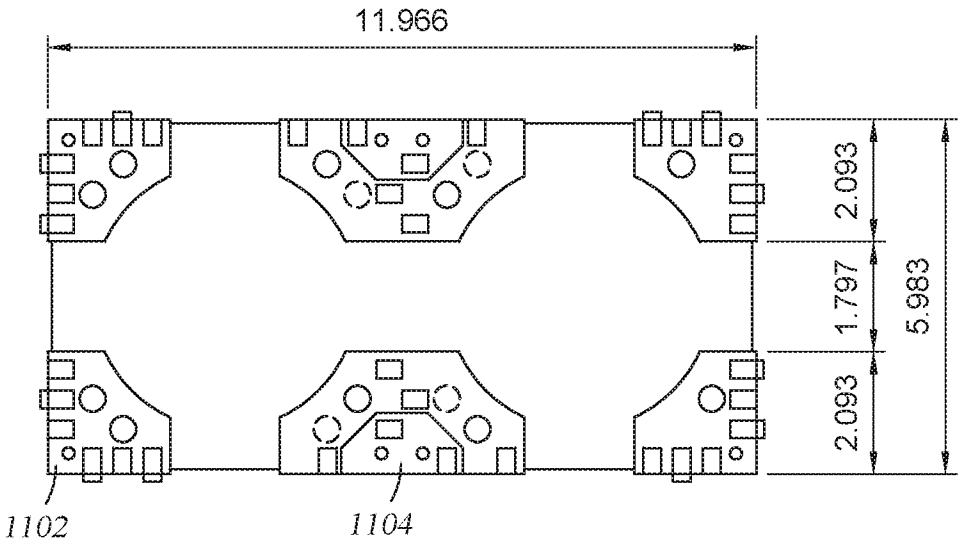
FIGS. 11A and 11B depict aspects of surface connector arrangements for modular containers.
Figure 11B:
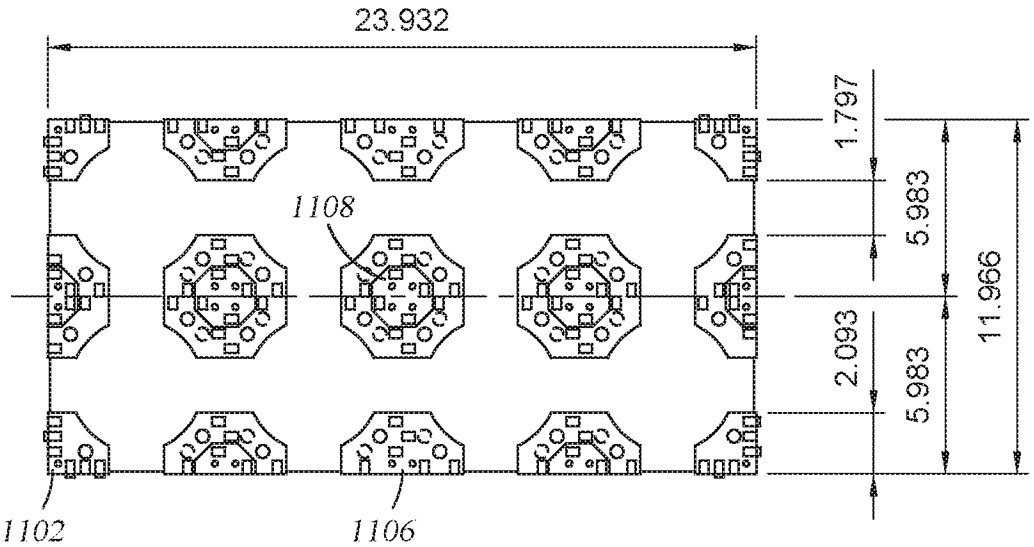

FIGS. 11A and 11B depict further aspects of surface connector arrangements for modular containers.

In FIG. 11A, modular container 1100 has is a rectangular cuboid and includes corner-mounted surface connectors 1102 of a larger variety as compared to those in FIGS. 10A and 10B. These corner-mounted surface connectors 1102 may be referred to herein as "intermediate" corner-mounted surface connectors. Like the small corner-mounted surface connectors described above, corner-mounted surface connectors 1102 include "male" and "female" connector elements. Further, in this embodiment, the "intermediate" connector comprises the "small" connector as a subset, but also includes the additional features.

Further, modular container 1100 includes small edge-mounted surface connectors 1104. Thus, surface connectors of different types can be included in a single modular container based on the types of modular containers that may be attached to modular container 1100 in use. Further, modular container 1100 includes small edge-mounted surface connectors 1104. Thus, surface connectors of different types can be included in a single modular container based on the expected sorts of modular containers that may be attached to modular container 1100 in use.

In FIG. 11B, modular container 1150, which is larger than modular container 1100, is also a rectangular cuboid that includes intermediate corner-mounted surface connectors 1102, intermediate edge-mounted surface connectors 1106, and small face-mounted surface connectors 1108.

Figure 12B:
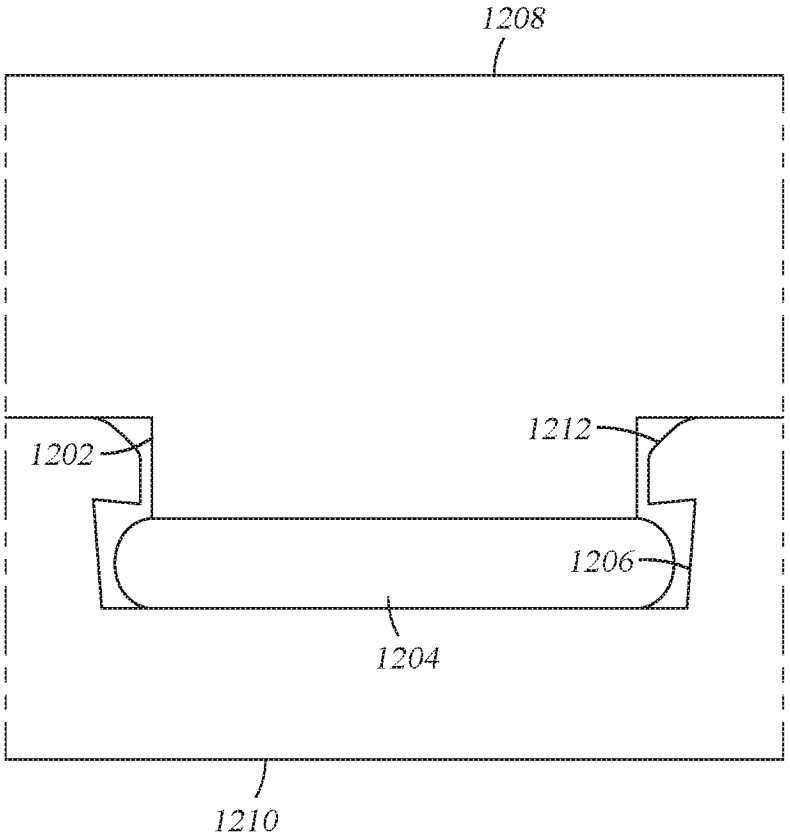
FIGS. 12A and 12B depict optional additional features of connector elements.
Figure 12A:
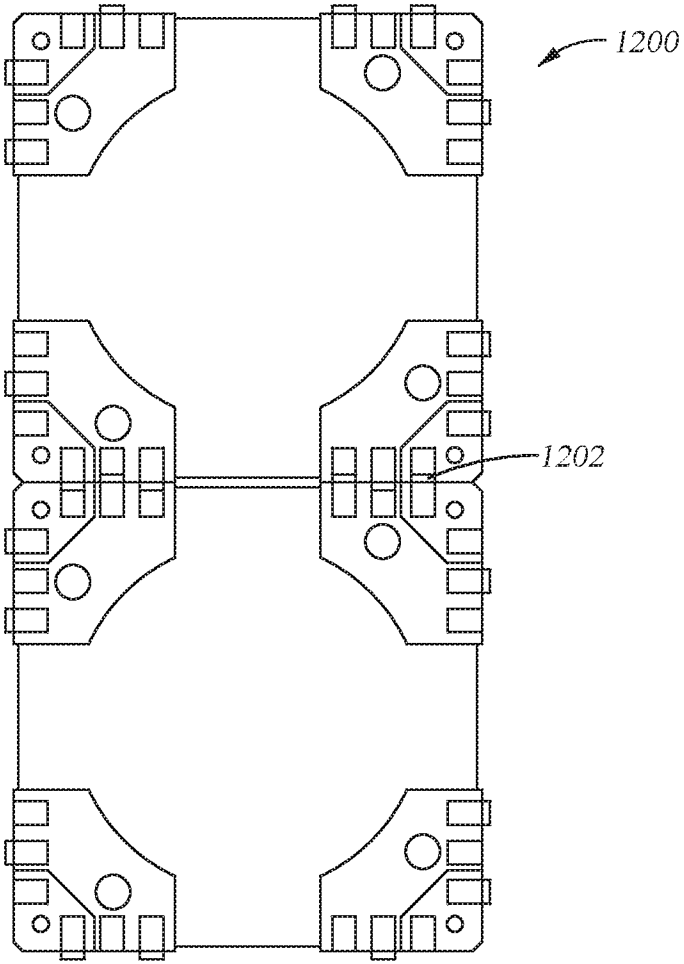

FIGS. 12A and 12B depicts optional features of connector elements. In particular, modular container 1200 may include connector elements, such as protrusions, equipped with a resilient, shock-absorbing material, such as rubber, which prevents damage to surfaces that modular container sits on and which also moderates the impact of modular containers as they are pushed together for connection. The resilient shock-absorbing material may be referred to as a bumper. Bumper are optional features that may be used as the shipping use case requires. For example, bumpers may be less important for commercial shipping operations (e.g., between warehouses), but may be more important in the residential shipping applications where avoiding damage to a recipient's surfaces is desirable.

As depicted, in FIG. 12B connector element 1202 of corner-mounted surface connector 1208 includes a protrusion and a rubber sole 1204 that fit within connector element 1206, which is a recess in this example. Thus, when surface connectors 1208 and 1210 come fully together, they are buffered by rubber sole 1204. Note that rubber sole 1204 is just one example, and many other shock-absorbing, resilient materials may be used.

In other embodiments, instead of or in addition to using a bumper, such as rubber sole 1204, the protrusion element may be movable and biased by a spring, or "spring-loaded." In such embodiments, if a recess is present at that location on the side of the adjacent container, the protrusion will interface with that recess, and those two elements can transfer shear forces from one container face to another. However, if the adjacent container face does not have a recess in that location, the protrusion can be pushed up into its own recess because of the spring-loading. This arrangement may be beneficial in that it allows a container to be adjacent to another container that is not equipped with recesses.

Further as depicted in FIG. 12B, features of connector elements may include draft angles or tapers (e.g., 1212), which helps connector elements to fit together more easily.

Surface Connector Arrangements for Corner Fittings

Surface connector arrangements, such as those described above, may also be used on corner fittings (e.g., large corner fittings). Corner fittings are different from corner-mounted surface connectors in that corner fittings are generally independent three-dimensional structures having their own interior volume that may be joined with, attached to, or made integral with a modular container, while corner-mounted surface connectors are generally joined with, attached to, or made integral with a surface of a modular container, but do not include their own interior volume.

In the following examples, corner fittings are depicted generally in a plan view with one face showing, but note that corner fittings are generally three dimensional, and may have multiple faces, such as six faces for rectangular cuboid shapes. The faces of a corner fitting are generally joined by edges. Because corner fittings may be designed to be permanently affixed to a container, such as welded to a container, some surfaces and edges may include surface connector elements and some may not. For example, internal faces (i.e., those pointing inward toward the container and not outward), may not include surface connector elements because they would not be able to engage (or interface) with other surface connector elements on other containers. Thus, as depicted in the following examples of corner fittings, certain edges that do not show protruding surface connector elements may be located on the inward-facing faces of the corner fittings.

Figure 13:
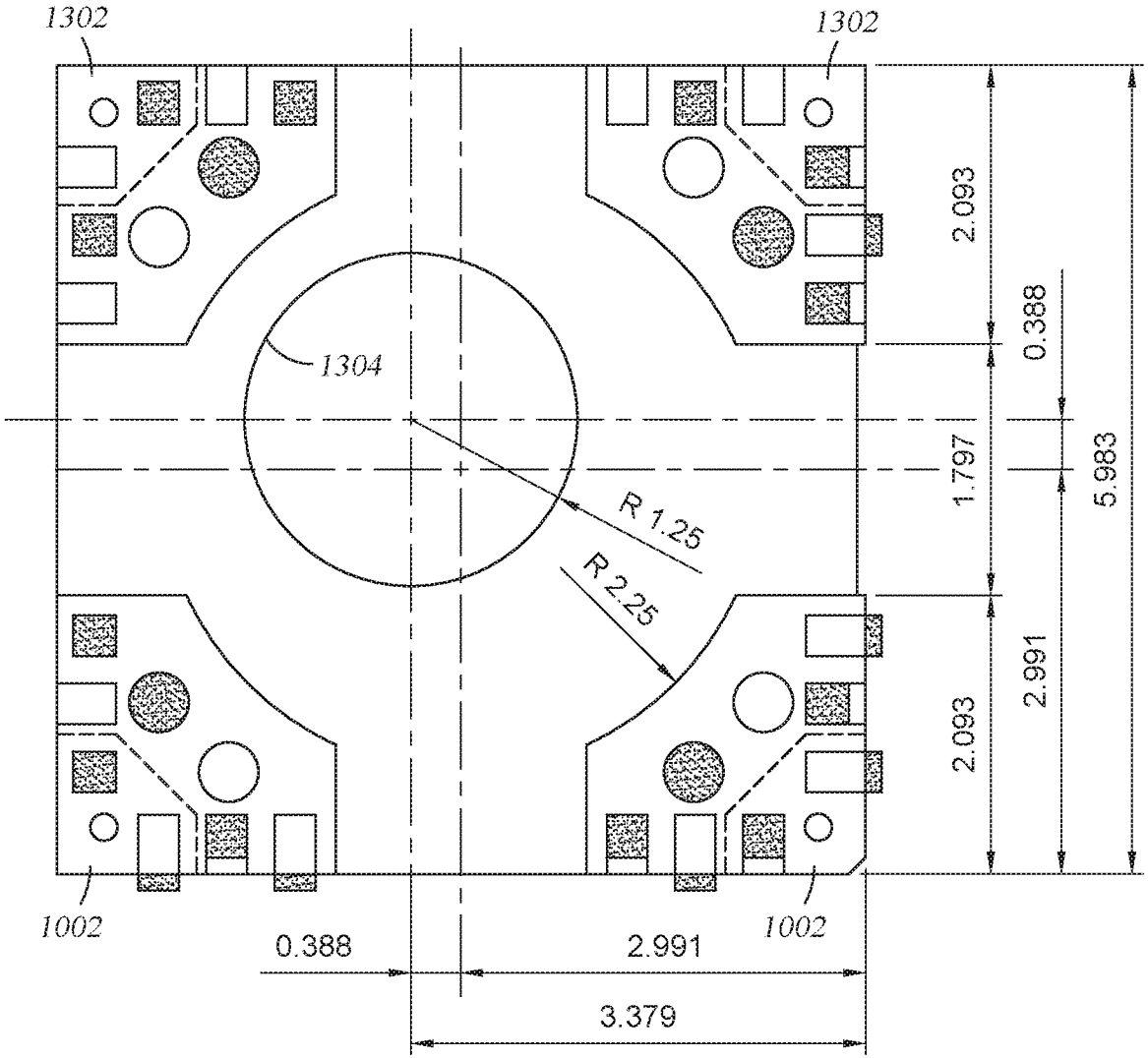
FIG. 13 depicts an example of a corner fitting including surface connectors.

FIG. 13 depicts an example of a corner fitting 1300 including surface connectors 1302.

As described above, modular containers may include corner fittings so that agglomerated containers may be made compatible with existing connection equipment. Corner fitting 1300 is one such example.

Corner fitting 1300 includes surface connectors 1302 arranged in an alternating pattern, as described above, which allows for modular containers using corner fitting 1300 to connect directly via the surface connectors with other smaller containers rather than the corner fitting aperture 1304 while accommodating the stronger connection hardware that interface directly between corner fittings of adjacent containers.

Notably, the center of aperture 1304 is offset 3.379 inches from a first edge of corner fitting 1300 (e.g., the right edge as depicted) and 3.379 inches from the second edge of corner fitting 1400 (e.g., the bottom edge, as depicted) to enable compatibility with the existing ISO standard dimensions.

Figure 14A:
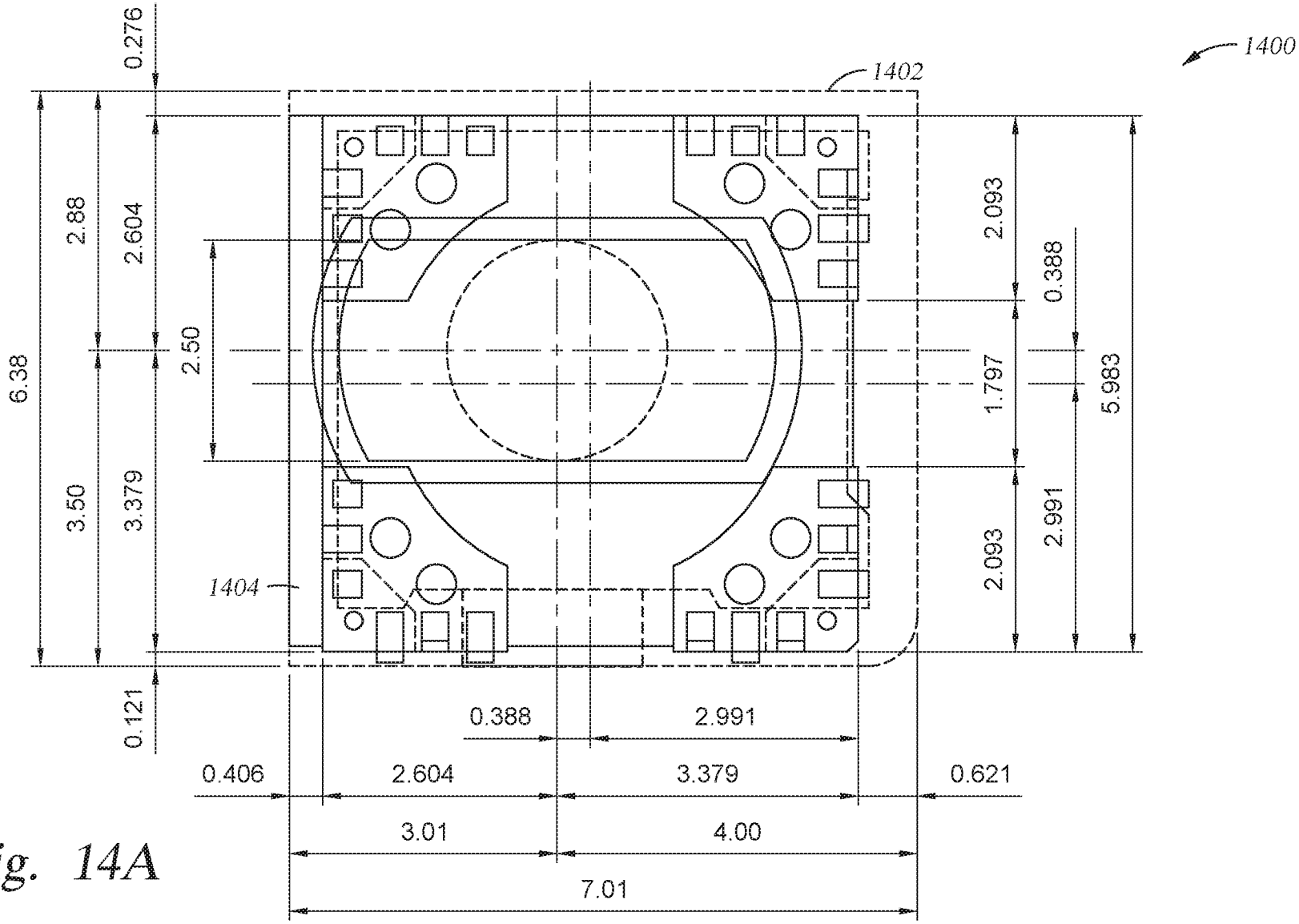
FIGS. 14A-14F depict additional examples of corner fittings that are backward compatible with ISO standard connection equipment.
Figure 14B:
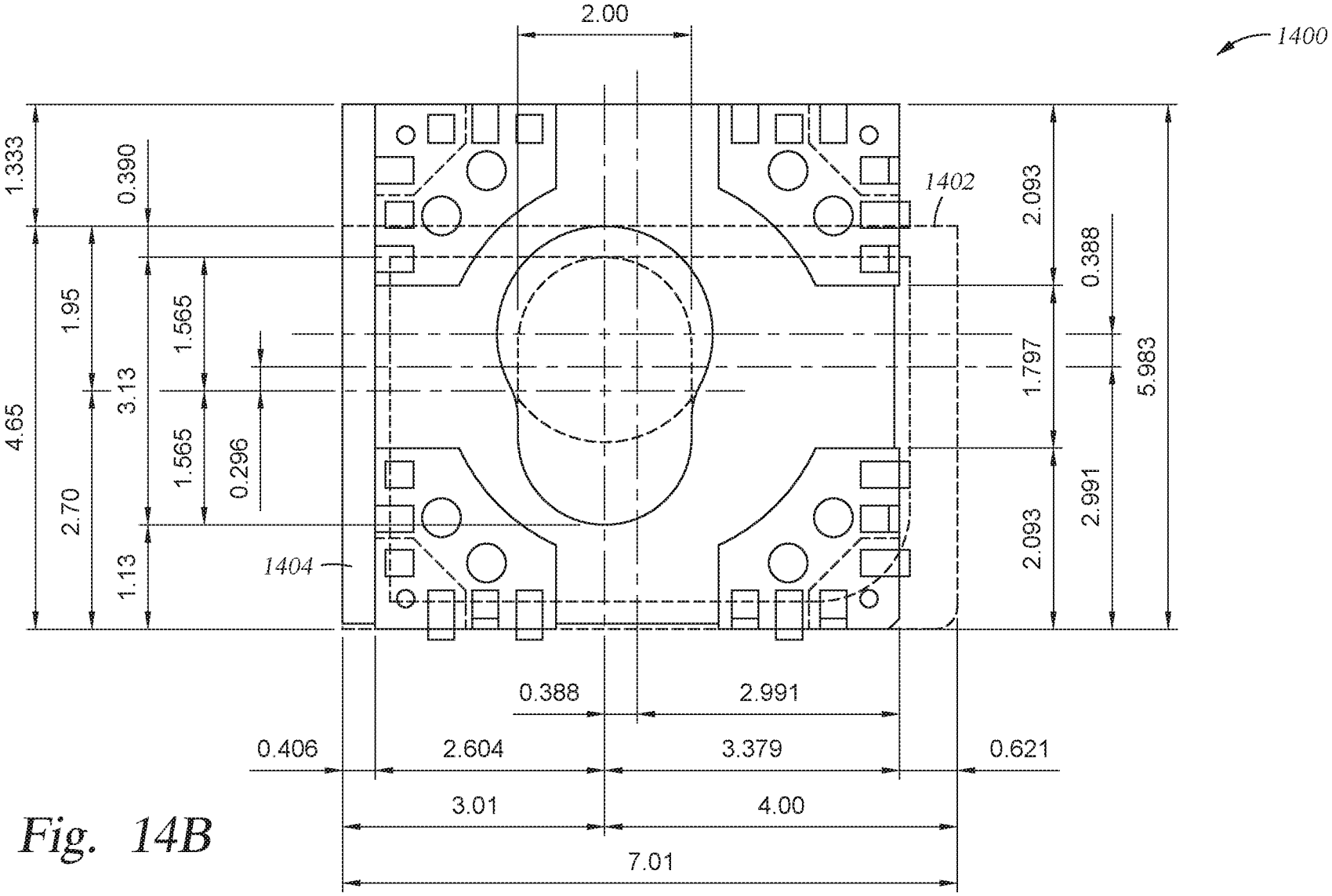
Figure 14C:
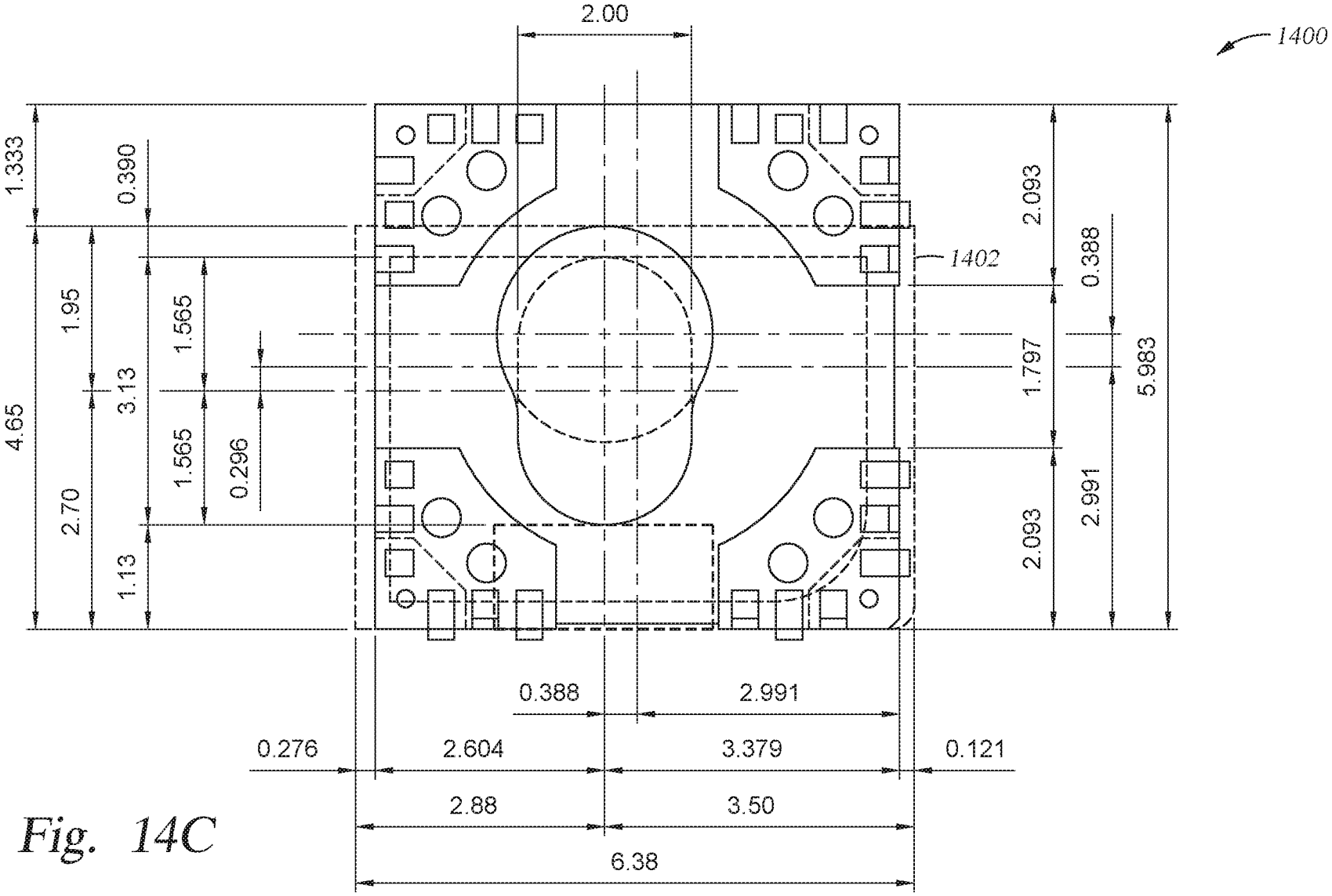

FIGS. 14A-14C depict another example of a top corner fitting 1400 that is backwards compatible with ISO standard connection equipment.

In particular, FIG. 14A depicts a bottom view of top corner fitting 1400 against an outline 1402 of an ISO standard 6-inch corner fitting. FIG. 14B depicts a side view of top corner fitting 1400 against an outline 1402 of an ISO standard 6-inch corner fitting. And FIG. 14C depicts an end view of top corner fitting 1400 against an outline 1402 of an ISO standard 6-inch corner fitting.

In FIGS. 14A and 14B, additional material 1404 is added to reinforce corner fitting 1400 for use with the existing arrangement of apertures according to the ISO standard.

Figure 14D:
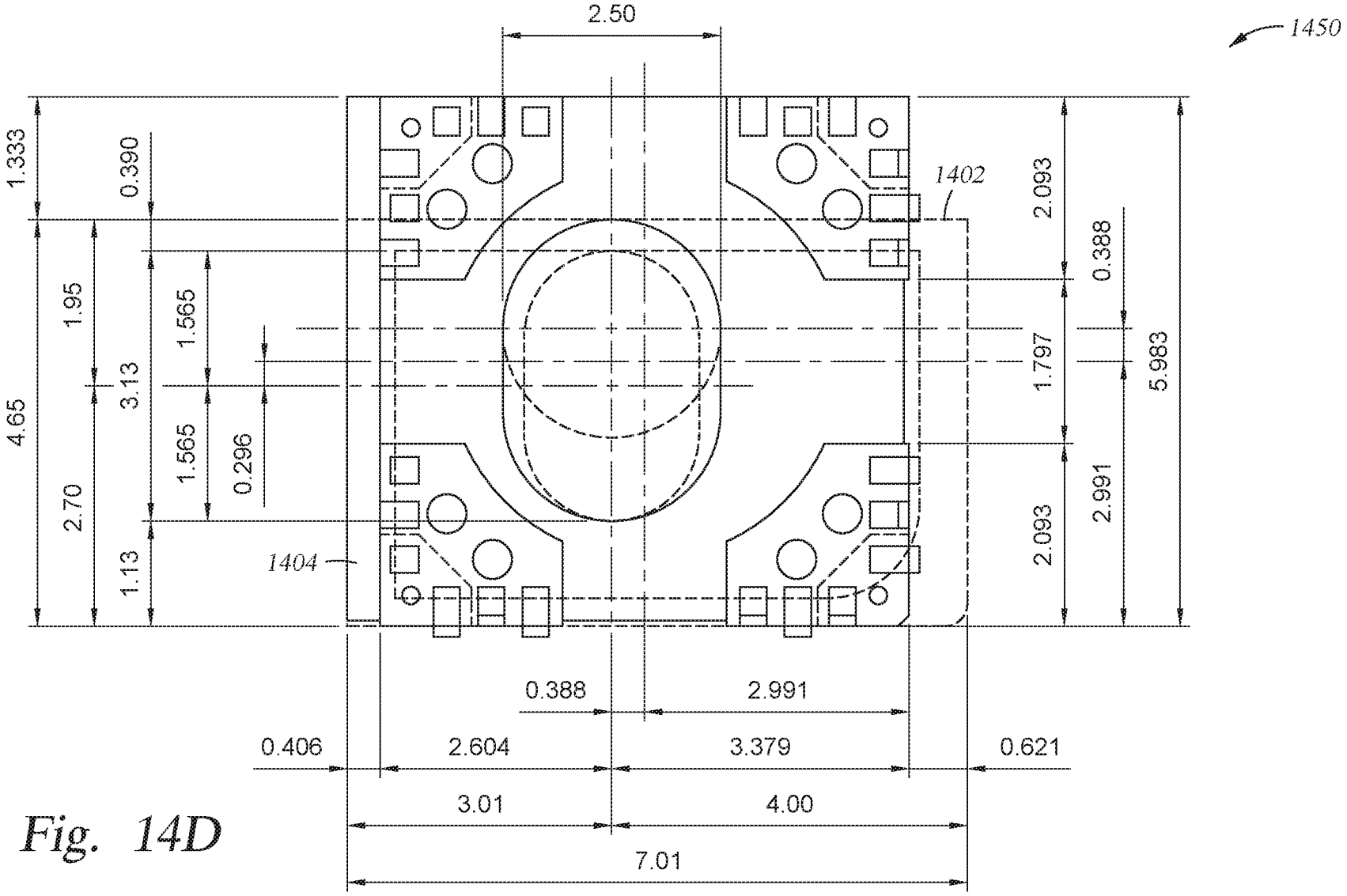
Figure 14E:
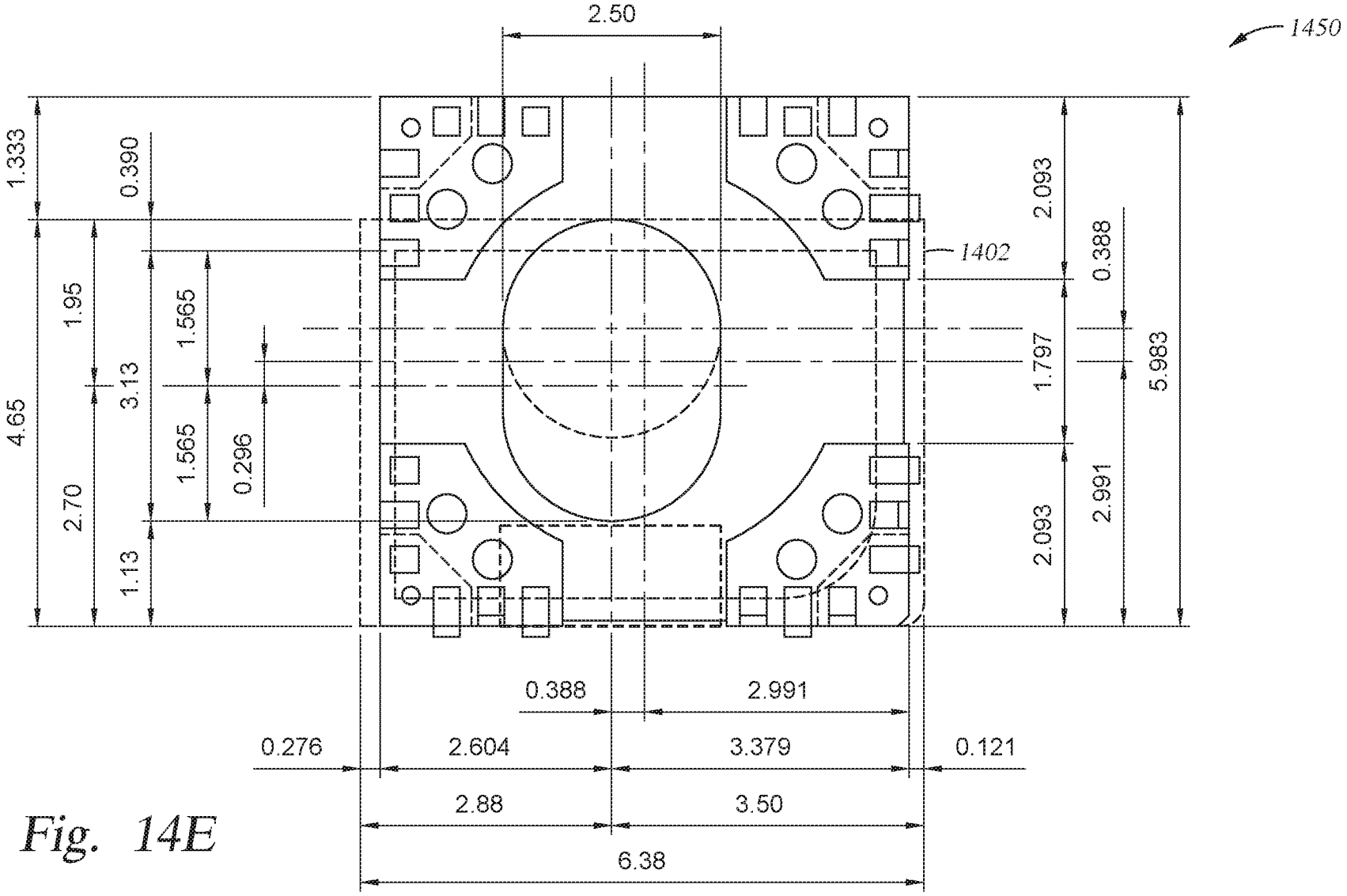

FIGS. 14D and 14E depict a side view and end view, respectively, of a bottom corner fitting 1450 with an alternative aperture geometry (compared to FIGS. 14B and 14C) that is pill shaped and 2.5 inches.

Figure 14F:
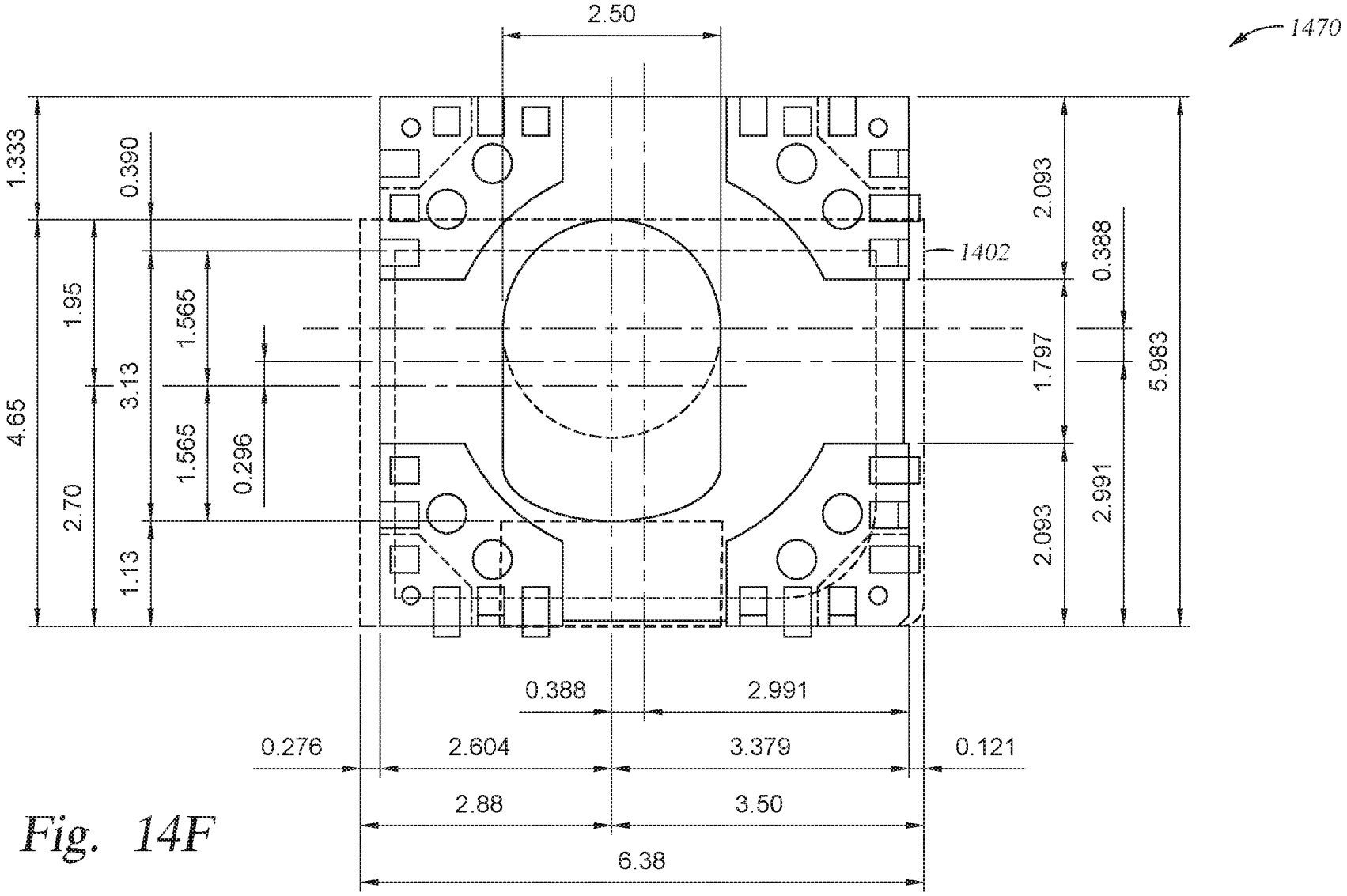

FIG. 14F depicts an end view of a top corner fitting 1470 with an alternative aperture geometry (compared to FIG. 14A).

Figure 15A:
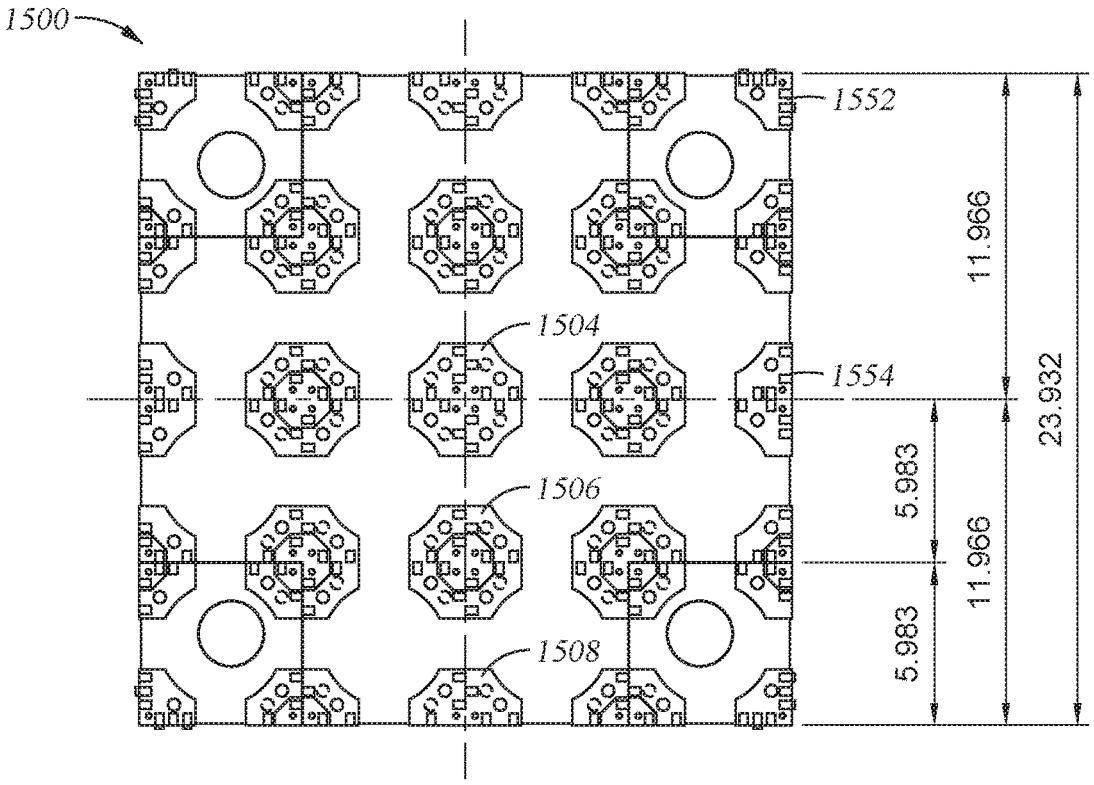
FIGS. 15A and 15B depict additional examples of corner fittings and surface connector arrangements.
Figure 15B:
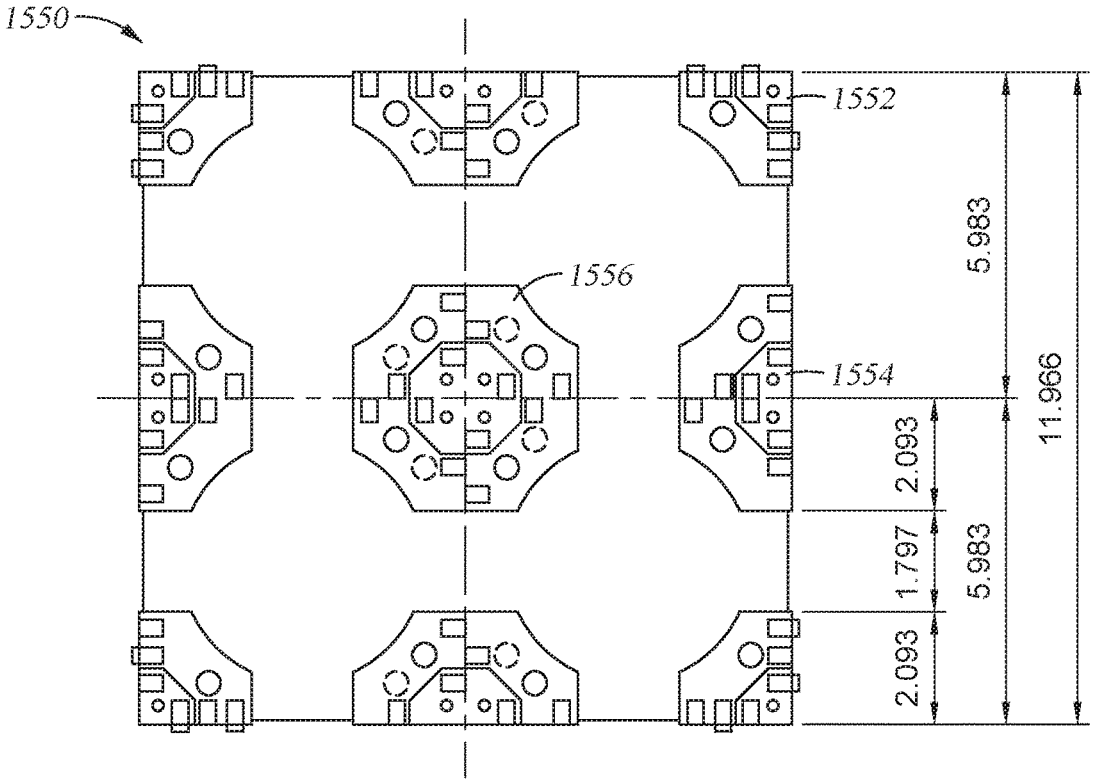

FIGS. 15A and 15B depict additional examples of corner fittings and surface connector arrangements.

In FIG. 15A, modular container 1500 includes 6-inch corner fittings 1502, which include an arrangement of surface connectors. Using large corner fittings with relatively smaller modular containers (2-foot in this example) may beneficially increase the strength and robustness of those modular containers such that they can be used for structural rigidity enhancement in an agglomerated container. For example, modular container 1500 may serve as part of a bottom layer of an agglomerated container, which bear the load of all the connected layers above, such as shown in FIG. 5 and FIG. 6. Such an arrangement also provides for additional mounting options, such as attachment devices that can interface with the apertures in corner fittings 1502.

Modular container 1500 also includes intermediate face-mounted surface connectors 1504, intermediate edge-mounted surface connectors 1508, and small face-mounted surface connectors 1506.

By contrast, FIG. 15B depicts an arrangement for a modular container that may not need the reinforcement as in FIG. 15A. So, in this example, modular container 1550 uses small corner-mounted surface connectors 1552 instead of corner fittings, small edge-mounted surface connectors 1554, and small face-mounted surface connectors 1556. Such an arrangement may reduce the tare weight of modular container 1550 so that more cargo can be carried in modular container 1550. Such an arrangement may also result in more interior volume in the container available for cargo. In addition, the use of small connectors may be less expensive compared to using larger connectors.

Note that access doors are generally not depicted in the figures of modular containers herein for simplicity. However, each modular container may comprise one or more access doors on one or more sides or faces for accessing internal cargo area. In some embodiments, the access doors may be shaped to accommodate various surface connector arrangements.

EXAMPLE METHODS

Figure 16:
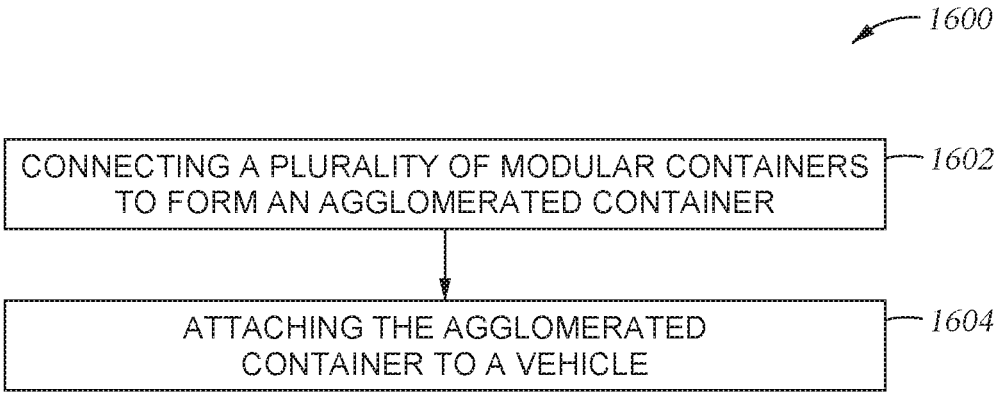
FIG. 16 depicts an example method for forming an agglomerated container.

FIG. 16 depicts an example method 1600 for forming an agglomerated container. comprising:

Method 1600 begins at step 1602 with connecting a plurality of modular containers to form an agglomerated container. For example, the modular containers may be as described above with respect to FIGS. 2-15B.

In some embodiments, each respective modular container of the plurality of modular containers comprises six sides, each side of the six sides of the respective modular container comprises at least eight container connectors, wherein: a first set of the at least eight container connectors are of a first type, and a second set of the at least eight container connectors are of a second type, and each respective modular container of the plurality of modular container is connected to another modular container of the plurality of modular containers via the at least eight container connectors.

In some embodiments, each of the plurality of modular containers is the same size, such as depicted in FIGS. 4 and 5. In some embodiments, each of the plurality of modular containers further comprises eight corner fittings, such as depicted in FIG. 4. In some embodiments, each respective corner fitting of the eight corner fittings for a respective modular container of the plurality of modular containers comprises a corner fitting hole centered approximately 3.379 inches from a first adjacent edge of the respective corner fitting and approximately 3.379 inches from a second edge of the respective corner fitting.

In some embodiments, the agglomerated container is approximately 95.727 inches wide, and the agglomerated container is approximately 95.727 inches long. This allows five agglomerated containers to occupy the same footprint as a 40-foot ISO container.

In some embodiments, the agglomerated container is approximately 95.727 inches wide, and the agglomerated container is approximately 119.659 inches long. This allows four agglomerated containers to occupy the same footprint as a 40-foot ISO container.

In some embodiments, the plurality of modular containers are arranged in a plurality of layers, such as depicted in FIGS. 2-7B. In some embodiments, a bottom layer of the plurality of layers comprises a first subset of the plurality of modular containers, wherein each modular container of the first subset of the plurality of modular containers comprises: eight corner fittings, such as depicted in FIGS. 4-7B. In some embodiments, each respective corner fitting of the eight corner fittings comprises a corner fitting hole centered approximately 3.379 inches from a first adjacent edge of the respective corner fitting and approximately 3.379 inches from a second edge of the respective corner fitting.

In some embodiments, a second layer of the plurality of layers comprises a second subset of the plurality of modular containers, and each modular container of the second subset of the plurality of modular containers is a different size than each modular container of the first subset of the plurality of modular containers. In some embodiments, each modular container of the second subset of the plurality of modular containers does not comprise a corner fitting, such as depicted in FIGS. 5-6.

Method 1600 then proceeds to step 1604 with attaching the agglomerated container to a vehicle. In some embodiments, the agglomerated container may be connected to the vehicle via one or more ISO container retainers.

In some embodiments, multiple agglomerated containers may be connected to ISO standard connection equipment on vehicle (e.g., a truck, trailer, or rail car).

The preceding description is provided to enable any person skilled in the art to practice the various embodiments described herein. The examples discussed herein are not limiting of the scope, applicability, or embodiments set forth in the claims. Various modifications to these embodiments will be readily apparent to those skilled in the art, and the generic principles defined herein may be applied to other embodiments. For example, changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

As used herein, the word "exemplary" means "serving as an example, instance, or illustration." Any aspect described herein as "exemplary" is not necessarily to be construed as preferred or advantageous over other aspects.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like.

As used herein, "approximately" with respect to a dimension means plus or minus standard manufacturing tolerances.

The methods disclosed herein comprise one or more steps or actions for achieving the methods. The method steps and/or actions may be interchanged with one another without departing from the scope of the claims. In other words, unless a specific order of steps or actions is specified, the order and/or use of specific steps and/or actions may be modified without departing from the scope of the claims. Further, the various operations of methods described above may be performed by any suitable means capable of performing the corresponding functions.

What is claimed is:

1. A modular container, comprising:
six sides, wherein:
each side of the six sides of the modular container comprises at least four surface connectors mounted to the modular container,
each surface connector of the at least four surface connectors comprises at least two connector elements,
at least one connector element of the at least two connector elements is of a first type comprising a protrusion, and
at least one connector element of the at least two connector elements is of a second type comprising a recess; and
an access door in at least one side of the six sides.

2. The modular container of claim 1, wherein each side of the six sides of the modular container further comprises four corner fittings.

3. The modular container of claim 2, wherein each corner fitting of the four corner fittings is adjacent to the at least two connectors elements.

4. The modular container of claim 3, wherein each respective corner fitting of the four corner fittings comprises:
a first face on a first side of the six sides of the modular container,
a second face on a second side of the six sides of the modular container,
a third face on a third side of the six sides of the modular container, and
an aperture centered approximately 3.379 inches from a first edge of the respective corner fitting and approximately 3.379 inches from a second edge of the respective corner fitting.

5. The modular container of claim 1, wherein at least two sides of the six sides of the modular container are rectangular.

6. The modular container of claim 1, wherein
the recess comprises a draft angle configured to assist with connecting with the at least one connector element of the first type.

7. The modular container of claim 1, wherein:
the at least one connector element of the first type further comprises a bumper on the protrusion, and
the bumper comprises a rubber material.

8. An agglomerated container, comprising:
a plurality of modular containers, wherein:
each respective modular container of the plurality of modular containers comprises six sides,
each side of the six sides of the respective modular container comprises at least four surface connectors mounted to the modular container,
each surface connector of the at least four surface connectors comprises at least two connector elements, wherein:
at least one connector element of the at least two connector elements is of a first type comprising a protrusion,
at least one connector element of the at least two connector elements is of a second type comprising a recess, and
each respective modular container of the plurality of modular containers is connected to another modular container of the plurality of modular containers via an interface between one or more connector elements on a first side of the respective modular container and one or more connector elements of a first side of the another modular container.

9. The agglomerated container of claim 8, wherein:
each of the plurality of modular containers is a same size,
each of the plurality of modular containers further comprises eight corner fittings, wherein:
each respective corner fitting of the eight corner fittings for a respective modular container of the plurality of modular containers comprises a corner fitting aperture centered approximately 3.379 inches from a first edge of the respective corner fitting and approximately 3.379 inches from a second edge of the respective corner fitting.

10. The agglomerated container of claim 8, wherein:
the agglomerated container is approximately 95.727 inches wide, and
the agglomerated container is approximately 95.727 inches long.

11. The agglomerated container of claim 8, wherein:
the agglomerated container is approximately 95.727 inches wide, and
the agglomerated container is approximately 119.659 inches long.

12. The agglomerated container of claim 8, wherein:
the plurality of modular containers is arranged in a plurality of layers,
a first layer of the plurality of layers comprises a first subset of the plurality of modular containers,
wherein each modular container of the first subset of the plurality of modular containers comprises:
eight corner fittings,
wherein each respective corner fitting of the eight corner fittings comprises a corner fitting aperture centered approximately 3.379 inches from a first edge of the respective corner fitting and approximately 3.379 inches from a second edge of the respective corner fitting.

13. The agglomerated container of claim 12, further comprising:
a second layer of the plurality of layers comprising a second subset of the plurality of modular containers,
wherein each modular container of the second subset of the plurality of modular containers does not comprise a corner fitting.

14. The agglomerated container of claim 8, wherein:
the plurality of modular containers is arranged in a plurality of layers,
a first layer of the plurality of layers has a first cross-sectional area, and
a second layer of the plurality of layers has a second cross-sectional area that is different than the first cross-sectional area.

15. The agglomerated container of claim 8, wherein:
the plurality of modular containers comprises a first subset of modular containers of a first size, and
the plurality of modular containers comprises a second subset of modular containers of a second size.

16. The agglomerated container of claim 8, wherein a height of the agglomerated container is greater than eight feet.

17. A method of forming an agglomerated container, comprising:
connecting a plurality of modular containers to form an agglomerated container, wherein:
each respective modular container of the plurality of modular containers comprises six sides, each side of the six sides of the respective modular container comprises at least four surface connectors mounted to the modular container, each surface connector of the at least four surface connectors comprises at least two connector elements, wherein:

at least one connector element of the at least two connector elements is of a first type comprising a protrusion, and at least one connector element of the at least two connector elements is of a second type comprising a recess, and each respective modular container of the plurality of modular containers is connected to another modular container of the plurality of modular containers via an interface between one or more connector elements on a first side of the respective modular container and one or more connector elements of a first side of the another modular container.

18. The method of claim 17, wherein:

each of the plurality of modular containers is a same size, and each of the plurality of modular containers further comprises eight corner fittings, each respective corner fitting of the eight corner fittings for a respective modular container of the plurality of modular containers comprises a corner fitting aperture centered approximately 3.379 inches from a first edge of the respective corner fitting and approximately 3.379 inches from a second edge of the respective corner fitting.

19. The method of claim 17, wherein:

the agglomerated container is approximately 95.727 inches wide, and the agglomerated container is approximately 95.727 inches long.

20. The method of claim 17, further comprising: attaching the agglomerated container to ISO standard connection equipment on a vehicle.

* * * * *